US007249560B2

(12) United States Patent
Inde et al.

(10) Patent No.: US 7,249,560 B2
(45) Date of Patent: Jul. 31, 2007

(54) INK SUPPLY AMOUNT ADJUSTMENT METHOD AND APPARATUS FOR PRINTING PRESS

(75) Inventors: Akihiro Inde, Ibaraki (JP); Hideki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 184 days.

(21) Appl. No.: 10/973,376

(22) Filed: Oct. 25, 2004

(65) Prior Publication Data

US 2005/0093898 A1 May 5, 2005

(30) Foreign Application Priority Data

Oct. 30, 2003 (JP) ..... 2003-370443

(51) Int. Cl.
*B41F 1/54* (2006.01)

(52) U.S. Cl. ..... 101/484; 101/365

(58) Field of Classification Search ..... 101/484, 101/365

See application file for complete search history.

(56) References Cited

U.S. PATENT DOCUMENTS 5,524,542 A * 6/1996 Toyama ..... 101/485
6,378,429 B1 * 4/2002 Tomita et al. ..... 101/365
6,604,466 B2 * 8/2003 Komori et al. ..... 101/484
6,615,727 B2 * 9/2003 Komori et al. ..... 101/484
6,732,645 B2 * 5/2004 Yamamoto et al. ..... 101/365
6,792,863 B2 * 9/2004 Yamamoto et al. ..... 101/484
6,883,432 B2 * 4/2005 Yamamoto et al. ..... 101/484
6,975,430 B1 * 12/2005 Tomita ..... 358/1.9
2002/0059879 A1 * 5/2002 Komori et al. ..... 101/484
2003/0066447 A1 * 4/2003 Yamamoto et al. ..... 101/365
2003/0217660 A1 * 11/2003 Yamamoto et al. ..... 101/365

FOREIGN PATENT DOCUMENTS

EP 1364784 11/2003
JP 2003-118077 A 4/2003

* cited by examiner

*Primary Examiner*—Minh Chau
(74) *Attorney, Agent, or Firm*—Blakely Sokoloff Taylor & Zafman

(57) ABSTRACT

In an ink supply amount adjustment method for a printing press, one of a density value and a color value of a printing product is measured. The difference between the measurement value and a preset reference value related to one of the density value and the color value is obtained. The relationship between the obtained difference and at least one of a preset first allowable difference and a preset second allowable difference larger than the first allowable difference is determined in accordance with a set allowance mode. The ink supply amount is adjusted in accordance with the determination result. An ink supply amount adjustment apparatus is also disclosed.

13 Claims, 40 Drawing Sheets

INK SUPPLY AMOUNT ADJUSTMENT METHOD AND APPARATUS FOR PRINTING PRESS

BACKGROUND OF THE INVENTION

The present invention relates to an ink supply amount adjustment method and apparatus for a printing press, which adjust the ink supply amount to a printing plate on the basis of the density value or color value of a printing product.

FIG. 28 shows the main part of the inking device (inker) in each color printing unit of a web offset printing press. Referring to FIG. 28, reference numeral 1 denotes an ink fountain; 2, ink stored in the ink fountain 1; 3, an ink fountain roller; 4-1 to 4-n, a plurality of ink keys juxtaposed in the axial direction of the ink fountain roller 3; 5, an ink ductor roller; 6, ink rollers; and 7, a printing plate mounted on a plate cylinder 8. An image is printed on the printing plate 7.

In this inking device, the ink 2 in the ink fountain 1 is supplied to the ink fountain roller 3 through the gap between the ink keys 4-1 to 4-n and the ink fountain roller 3. The ink supplied to the ink fountain roller 3 is supplied to the printing plate 7 through the ink rollers 6 by the duct operation of the ink ductor roller 5. The ink supplied to the printing plate 7 is printed on a printing paper sheet through a blanket cylinder (not shown).

FIG. 2 shows a printing product printed by this printing press. A band-shaped color bar 9-2 is printed on the margin portion of a printing product 9 except an image region 9-1. In general four-color printing, the color bar 9-2 includes regions S1 to Sn including density measurement patches (solid patches at a percent dot area of 100%) 9*a*1, 9*a*2, 9*a*3, and 9*a*4 of black, cyan, magenta, and yellow. The regions S1 to Sn correspond to the key zones of ink keys 4-1 to 4-n-1 to 4-n in each color printing unit of the printing press.

[Color Matching]

A reference density value is set in advance for each color printing unit. More specifically, a reference density value is set in advance for each of black, cyan, magenta, and yellow. In printing the printing product 9, a color matching operation is done to make the density value of each color coincide with the reference density value. This color matching operation is executed by the ink supply amount adjustment apparatus before final printing (at the time of preparation for printing) or during final printing on the basis of the density of a density measurement patch 9*a* (9*a*1, 9*a*2, 9*a*3, or 9*a*4) of each color in the color bar 9-2 printed on the printing product 9.

For example, the region S1 in the printing product 9 will be described as a representative. The density value of the density measurement patch 9*a* of each color on the printing product 9, which is extracted before or during final printing, is measured. The difference between the measured density value of each color and the preset reference density value of each color is obtained. The adjustment amounts of the opening ratios of the ink keys 4-1 to 4-n-1 (the adjustment amounts of ink supply amounts to the region S1) in each color printing unit are obtained from the obtained density difference of each color. The obtained adjustment amounts (reference correction amounts) are multiplied by a unique coefficient (control ratio) to obtain a correction amount. The correction amount is fed back to adjust the opening ratios of the ink keys 4-1 to 4-n-1 in each color printing unit.

In a similar way, for regions S2 to Sn as well, the adjustment amounts of the opening ratios of the ink keys 4-1 to 4-n-2 to 4-n (the adjustment amounts of ink supply amounts to the regions S2 to Sn) in each color printing unit are obtained. The obtained adjustment amounts (reference correction amounts) are multiplied by a control ratio to obtain a correction amount. The correction amount is fed back to adjust the opening ratios of the ink keys 4-1 to 4-n-2 to 4-n in each color printing unit.

In adjusting the opening ratios of the ink keys 4-1 to 4-n in each color printing unit, the only allowable density difference of each color is defined for the density difference (measured density difference) between the measured density value of each color (measured density difference) and the preset reference density value of each color. The ink supply amount is adjusted for only colors whose measured density differences are larger than the allowable density difference (Japanese Patent Laid-Open No. 2003-118077).

In the above-described conventional ink supply amount adjustment method, however, only one kind of allowable density difference is defined for the measured density difference of each color. This causes the following problems.

For example, assume that the allowable density difference is small, and the ink supply amount adjustment interval (printing product sampling interval) is short. In this case, before the influence of the precedingly adjusted ink supply amount is sufficiently reflected on the printing product, the next ink supply amount adjustment is done. Accordingly, a hunting phenomenon (the color tone becomes unstable because of the variation in color density on the printing product) of the ink thickness on the paper sheet occurs.

In addition, the density value of a specific part of the printing product may temporarily largely vary due to an unexpected accident (paper fold error, paper breakage, or smear) on the printing product. In this case, the ink supply amount is adjusted to a value largely shifted from what the ink supply amount should be. As a result, the amount of wasted paper increases.

SUMMARY OF THE INVENTION

It is an object of the present invention to provide an ink supply amount adjustment method and apparatus for a printing press, which suppress hunting in color matching.

It is another object of the present invention to provide an ink supply amount adjustment method and apparatus for a printing press, which can prevent any wasted paper even when an unexpected accident has occurred on a printing product.

In order to achieve the above objects, according to the present invention, there is provided an ink supply amount adjustment method for a printing press, comprising the steps of measuring one of a density value and a color value of a printing product, obtaining a difference between the measurement value and a preset reference value related to one of the density value and the color value, determining, in accordance with a set allowance mode, a relationship between the obtained difference and at least one of a preset first allowable difference and a preset second allowable difference larger than the first allowable difference, and adjusting an ink supply amount in accordance with a determination result.

DESCRIPTION OF THE PREFERRED EMBODIMENTS

First Embodiment

A density measurement and ink supply amount adjustment apparatus (to be simply referred to as an ink supply amount adjustment apparatus hereinafter) according to the first embodiment of the present invention will be described below with reference to FIGS. 1 to 5. An ink supply amount adjustment apparatus 10 according to this embodiment comprises a CPU (Central Processing Unit) 10A, RAM (Random Access Memory) 10B, ROM (Read Only Memory) 10C, input device 10D, display device 10E, output device 10F, input/output interfaces (I/Os) 10G to 10J, colorimeter 10K, colorimeter moving motor 10L, rotary encoder 10M, motor driver 10N, counter 10P, A/D (Analog-to-Digital) converter 10Q, D/A (Digital-to-Analog) converter 10R, and memories M1 to M13.

The CPU 10A operates in accordance with a program stored in the ROM 10C while obtaining various kinds of input information given through the interfaces 10G to 10J and accessing the RAM 10B or memories M1 to M13. The input device 10D has a printing state input switch SW1, density measurement start switch SW2, control end switch SW3, and allowable value condition input switch SW4. The rotary encoder 10M generates a rotation pulse for each predetermined number of revolutions (angle) of the motor 10L and outputs the pulse to the counter 10P.

Figure 1:
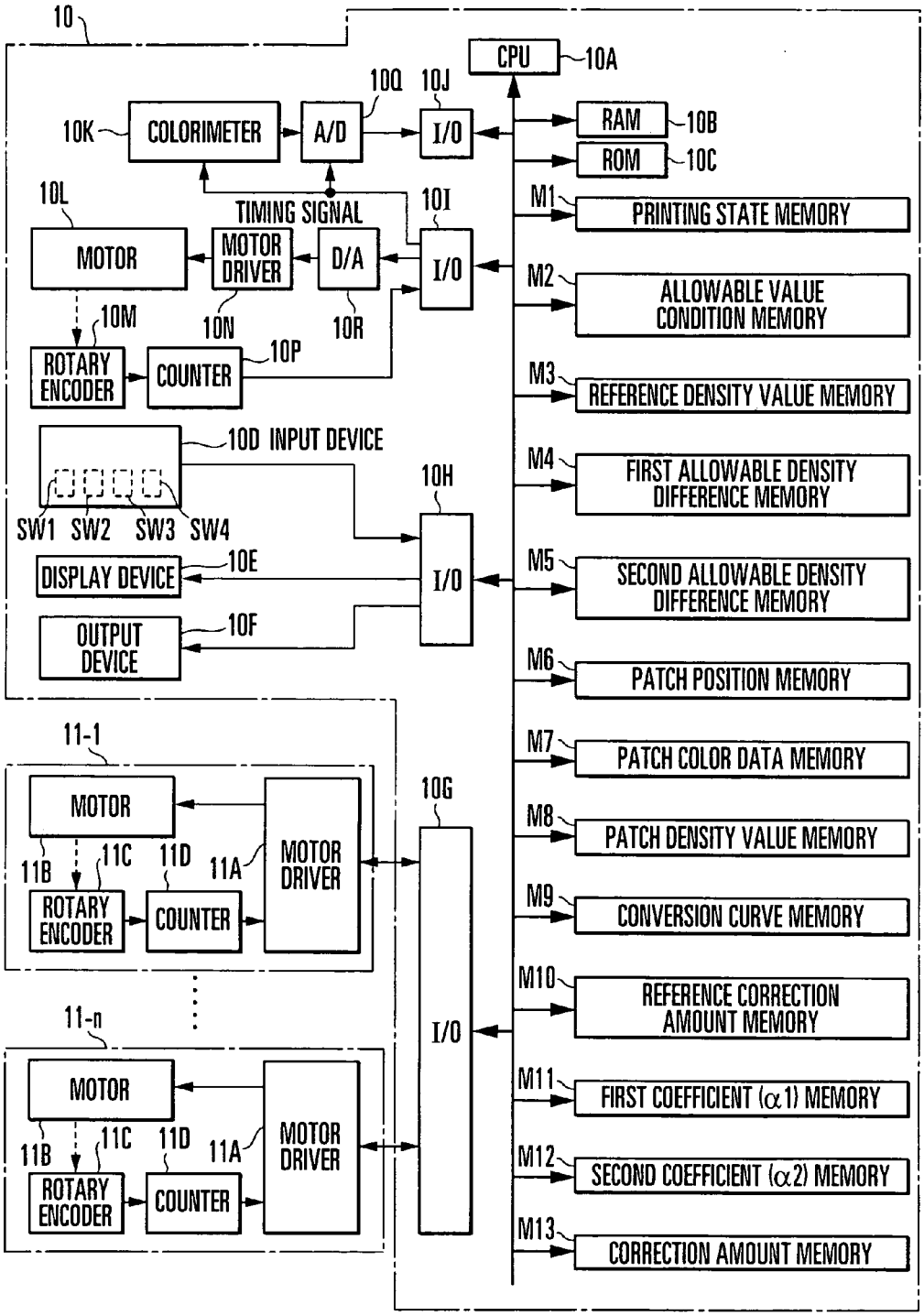
FIG. 1 is a block diagram of an ink supply amount adjustment apparatus according to the first embodiment of the present invention.
Figure 2:
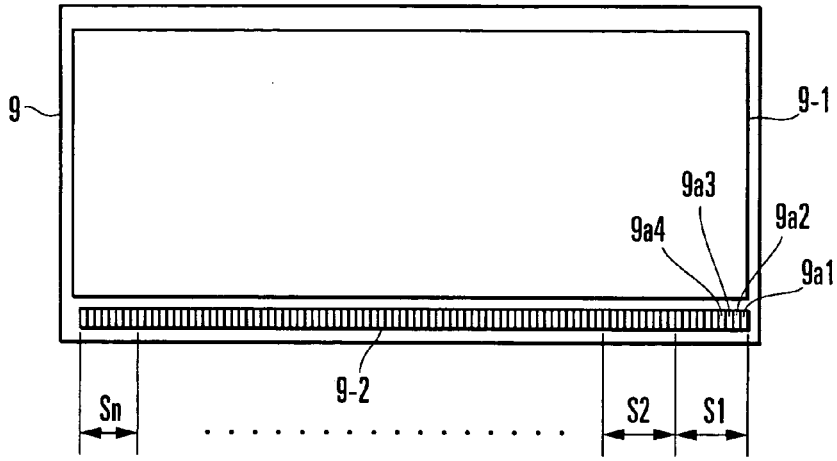
FIG. 2 is a plan view schematically showing a printing product printed by a printing press.
Figure 28:
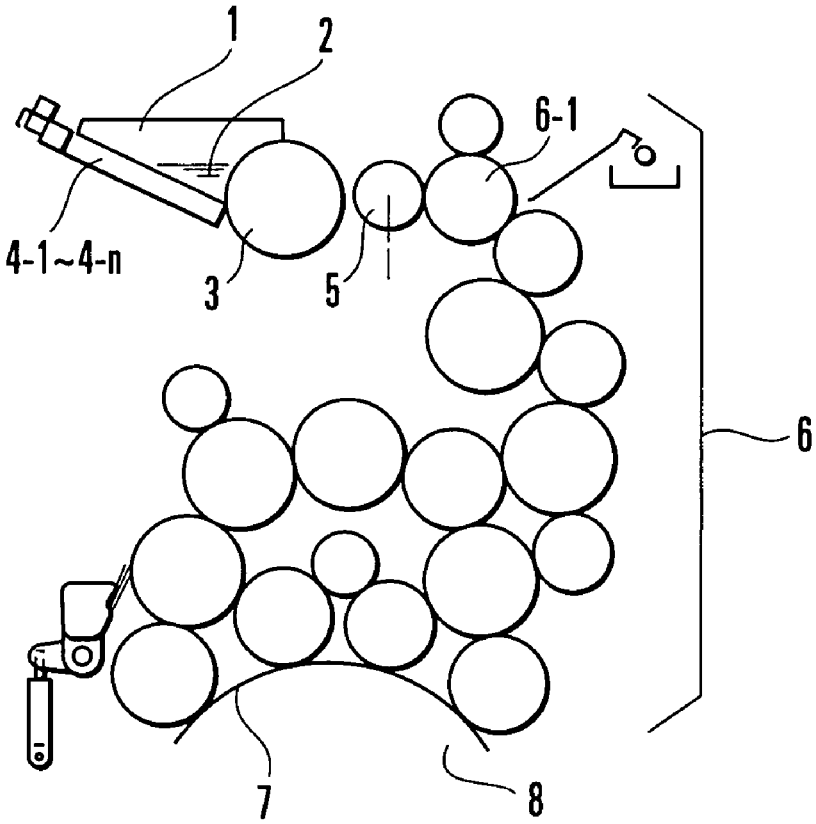
FIG. 28 is a view showing the main part of the ink supply device in each color printing unit of a web offset printing press.

Referring to FIG. 1, reference numerals 11-1 to 11-n denote control devices of ink key driving motors which are individually arranged in correspondence with the ink keys 4-1 to 4-n of the respective colors shown in FIG. 28. The motor control devices 11-1 to 11-n individually adjust the opening ratios of the ink keys 4-1 to 4-n for an ink fountain roller 3. Each of the motor control devices 11-1 to 11-n comprises an ink key driving motor driver 11A, ink key driving motor 11B, rotary encoder 11C, and counter 11D. The motor control devices 11-1 to 11-n are connected to the CPU 10A through the input/output interface 10G. The rotary encoder 11C generates a rotation pulse for each predetermined number of revolutions (angle) of the motor 11B and outputs the pulse to the counter 11D.

The memories M1 to M13 of the ink supply amount adjustment apparatus 10 will be described next.

The ON/OFF state of the printing state input switch SW1 in the input device 10D is stored in the printing state memory M1 as a printing state mode. The ON/OFF state of the allowable value condition input switch SW4 in the input device 10D is stored in the allowable value condition memory M2 as an allowance mode. The reference density value (the reference density value of each color) with respect to the density measurement patch 9*a* of each color in the color bar 9-2 printed on a printing product 9 (FIG. 2) is stored in the reference density value memory M3.

The first allowable density difference (the first allowable density difference of each color) with respect to the density measurement patch 9*a* of each color in the color bar 9-2 is stored in the first allowable density difference memory M4. The second allowable density difference (the second allowable density difference of each color) with respect to the density measurement patch 9*a* of each color in the color bar 9-2 is stored in the second allowable density difference memory M5. The second allowable density difference of each color is set larger than the first allowable density difference.

The measurement position of the density measurement patch 9*a* of each color in the color bar 9-2 is stored in the patch position memory M6. The color data of the density measurement patch 9*a* of each color in the color bar 9-2, which is sampled by the colorimeter 10K, is stored in the patch color data memory M7. A density value obtained from the color data of the density measurement patch 9*a* of each color in the color bar 9-2, which is sampled by the colorimeter 10K, is stored in the patch density value memory M8.

A conversion curve is stored in the conversion curve memory M9. The conversion curve represents the relationship between the difference between the measured density value and the reference density value of each color and the adjustment amount of the opening ratio of the ink key. The adjustment amount (reference correction amount) of the opening ratio of each ink key is stored in the reference correction amount memory M10. The adjustment amount is obtained from the conversion curve in the memory M9. A first coefficient (first control ratio) $\alpha 1$ is stored in the first coefficient memory M11. The first coefficient $\alpha 1$ is used to correct the reference correction amount of the opening ratio of each ink key. A second coefficient (second control ratio) $\alpha 2$ is stored in the second coefficient memory M12. The second coefficient $\alpha 2$ is used to correct the reference correction amount of the opening ratio of each ink key. The first coefficient al and second coefficient $\alpha 2$ are different from each other and are set to $\alpha 1 > \alpha 2$. The correction amount of the opening ratio of each ink key is stored in the correction amount memory M13. The correction amount is corrected by using the coefficient $\alpha$ or $\alpha 2$.

Figure 3:
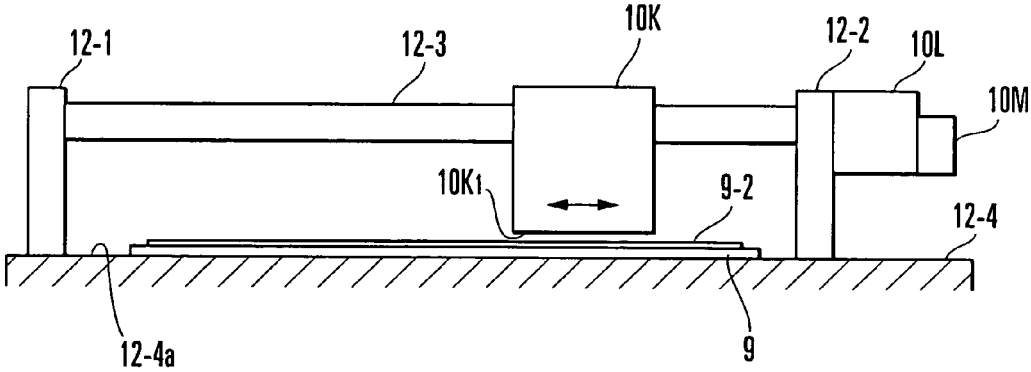
FIG. 3 is a side view showing the installed state of a calorimeter.

As shown in FIG. 3, the colorimeter 10K is attached to a ball screw (feed screw) 12-3 arranged between columns 12-1 and 12-2. The ball screw 12-3 is rotated in the forward or reverse direction by the motor 10L. As the ball screw 12-3 rotates in the forward or reverse direction, the calorimeter 10K moves between the columns 12-1 and 12-2 while being guided by the ball screw 12-3. A head portion $10K_1$ of the colorimeter 10K is directed to a surface 12-4*a* of a measurement table 12-4 on which an object to be measured is placed.

[Color Matching Before Start of Final Printing (Color Matching at Time of Preparation for Printing)]

In color matching before the start of final printing, the operator sets, on the measurement table 12-4 (FIG. 3), the printing product 9 printed by the printing press as an object to be measured. In this set state, the color bar 9-2 printed on the printing product 9 is located under the head portion $10K_1$ of the colorimeter 10K.

In this state, the operator instructs the start of the color matching operation through the input device 10D. Accordingly, the CPU 10A stores "0" in the memory M1 (step S101 shown in FIG. 4A). The CPU 10A also stores "0" in the memory M2 (step S102). Next, the operator inputs the reference density value, first allowable density difference, and second allowable density difference of each color from the input device 10D (step S103). The operator also inputs the position of each patch of each color in the color bar 9-2 from the input device 10D (step S104). The second allowable density difference of each color is input as a value larger than the first allowable density difference.

The CPU 10A stores the input reference density value of each color in the memory M3. The CPU 10A stores the input first allowable density difference of each color in the memory M4. The CPU 10A stores the input second allowable density difference of each color in the memory M5 (step S103). In addition, the position of the patch of each color to be measured by the calorimeter 10K, i.e., the position (measurement position) of the density measurement patch 9*a* of each color is calculated. The calculated measurement position is stored in the memory M6 (step S105).

The operator inputs the first coefficient $\alpha 1$ and second coefficient $\alpha 2$ to correct the reference correction amount of the opening ratio of each ink key. The CPU 10A stores the input first coefficient $\alpha 1$ in the memory M11. The CPU 10A stores the second coefficient $\alpha 2$ in the memory M12 (step S106).

The operator turns on the density measurement start switch SW2 in the input device 10D ("YES" in step S119). The CPU 10A rotates the motor 10L in the forward direction (step S121 shown in FIG. 4B). As the motor 10L rotates in the forward direction, the ball screw 12-3 rotates in the forward direction. The colorimeter 10K is guided by the ball screw 12-3 and moves from the home position in contact with the column 12-1 toward the column 12-2.

After the first and second coefficients $\alpha 1$ and $\alpha 2$ are stored in the memories M11 and M12 in step S106, the CPU 10A repeats the loop of step S107→S112→S119 →S120. Accordingly, the states of the printing state input switch SW1, allowable value condition input switch SW4, density measurement start switch SW2, and control end switch SW3 are monitored. In this case, since the density measurement start switch SW2 is turned on, the flow advances to step S121 to move the colorimeter 10K.

The CPU 10A monitors every moving position of the colorimeter 10K through the rotary encoder 10M (step S122). When the colorimeter 10K has reached the first measurement position stored in the memory M6, the color data of the patch 9*a* located at that measurement position is sampled by the colorimeter 10K (step S123). The CPU 10A stores the color data (colorimetric data) from the calorimeter 10K in the memory M7 (step S124).

In a similar way, every time reaching the measurement position stored in the memory M6, the CPU 10A causes the colorimeter 10K to sample the color data of the patch 9*a* located at that measurement position and stores the color data in the memory M7. That is, the CPU 10A executes automatic scanning control of the calorimeter 10K to sequentially sample the color data of the density measurement patch 9*a* of each patch in the color bar 9-2 printed on the printing product 9.

The CPU 10A determines whether the color data sampling of all patches 9*a* of the color bar 9-2 is ended (step S125).

When sampling is ended, the forward rotation of the motor 10L is stopped (step S126). Next, the CPU 10A rotates the motor 10L in the reverse direction (step S127) to return the calorimeter 10K to the home position. Then, the reverse rotation of the motor 10L is stopped (steps S128 and S129).

The CPU 10A calculates the density value of the patch 9*a* of each color from the calorimetric data of the patch 9*a* of each color stored in the memory M7 and stores the density value in the memory M8 (step S130). As the colorimeter 10K, a spectrometer is used. The output value of each wavelength from the spectrometer is multiplied by the transmittance of each wavelength of the filter to be used to measure the solid patch of each color by a densitometer. The calculated values are totalized to obtain the density value of each color.

The CPU 10A reads out the reference density value of each color from the memory M3 (step S131). The density difference between the measured density value of the patch 9*a* of each color stored in the memory M8 and the reference density value of each color is calculated (step S132). On the basis of the density difference between the density value of the patch 9*a* of each color and the reference density value of each color, the CPU 10A obtains the adjustment amount of the opening ratio of a corresponding ink key by using a conversion table. The conversion table represents the relationship between the difference between the measured density value and the reference density value of each color stored in the memory M9 and the adjustment amount of the ink key opening ratio. The obtained adjustment amount (reference correction amount) is stored in the memory M10 (step S133).

Figure 4A:
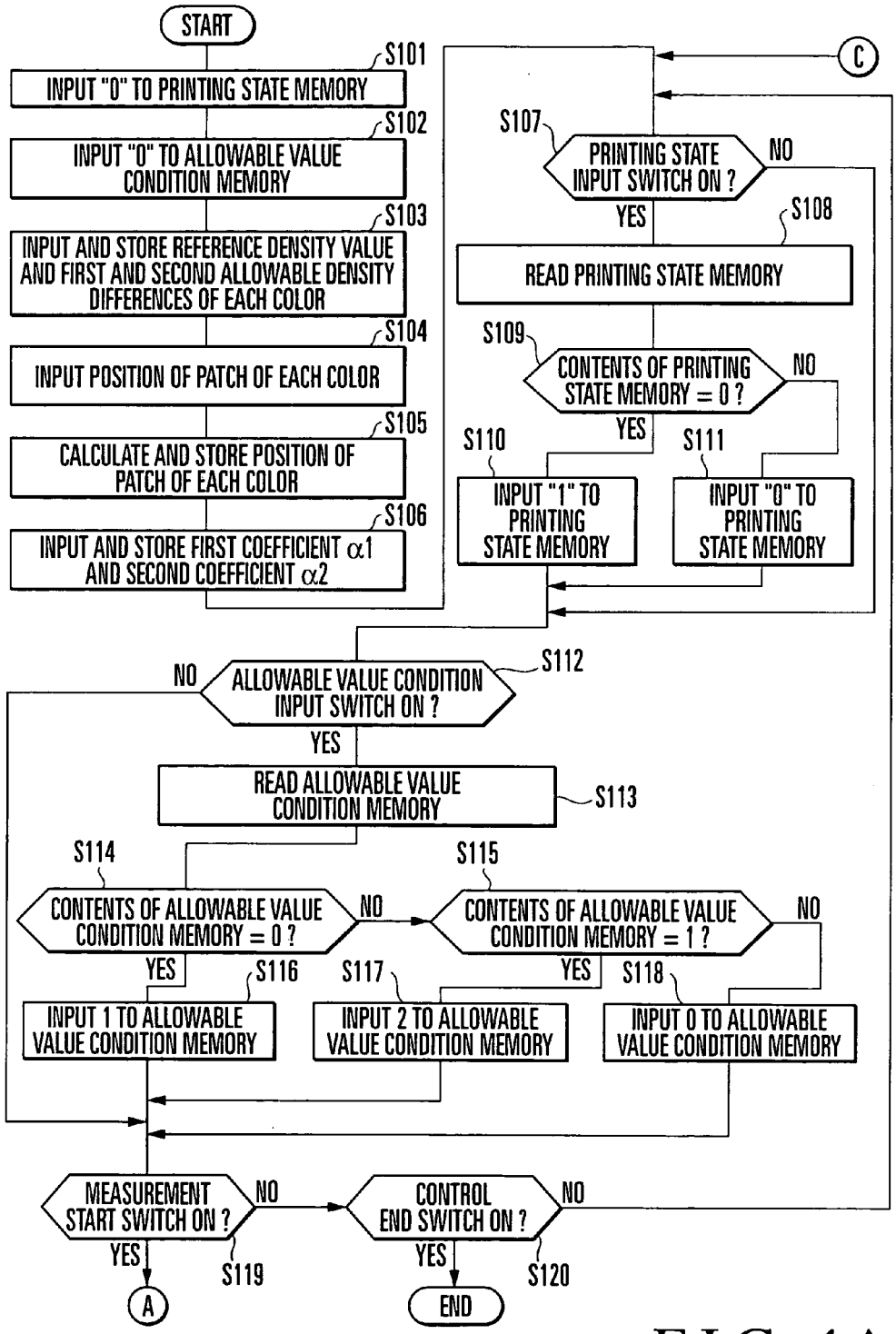
FIGS. 4A to 4C are flowcharts showing the processing operation of the ink supply amount adjustment apparatus shown in FIG. 1.
Figure 4B:
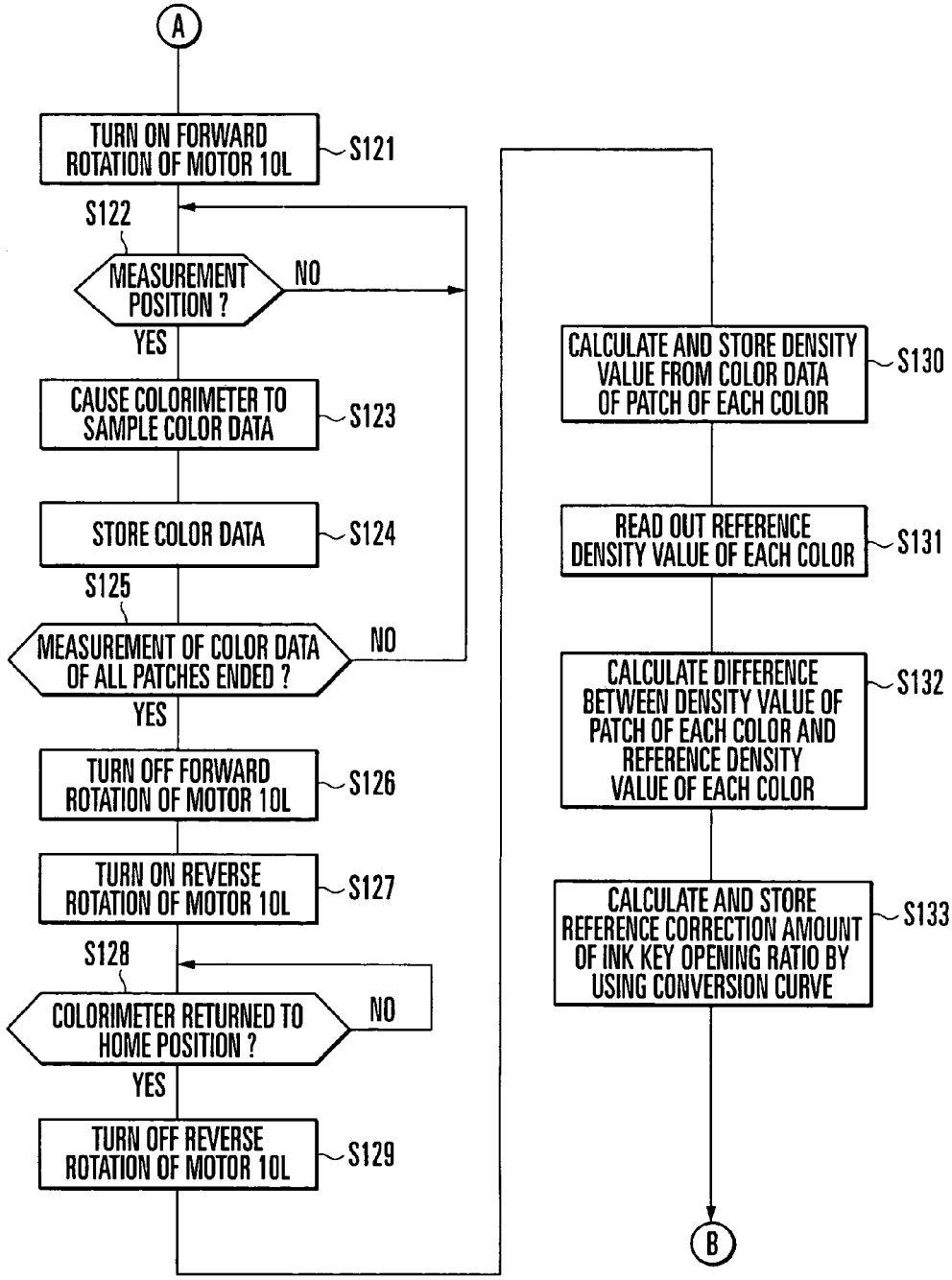
Figure 4C:
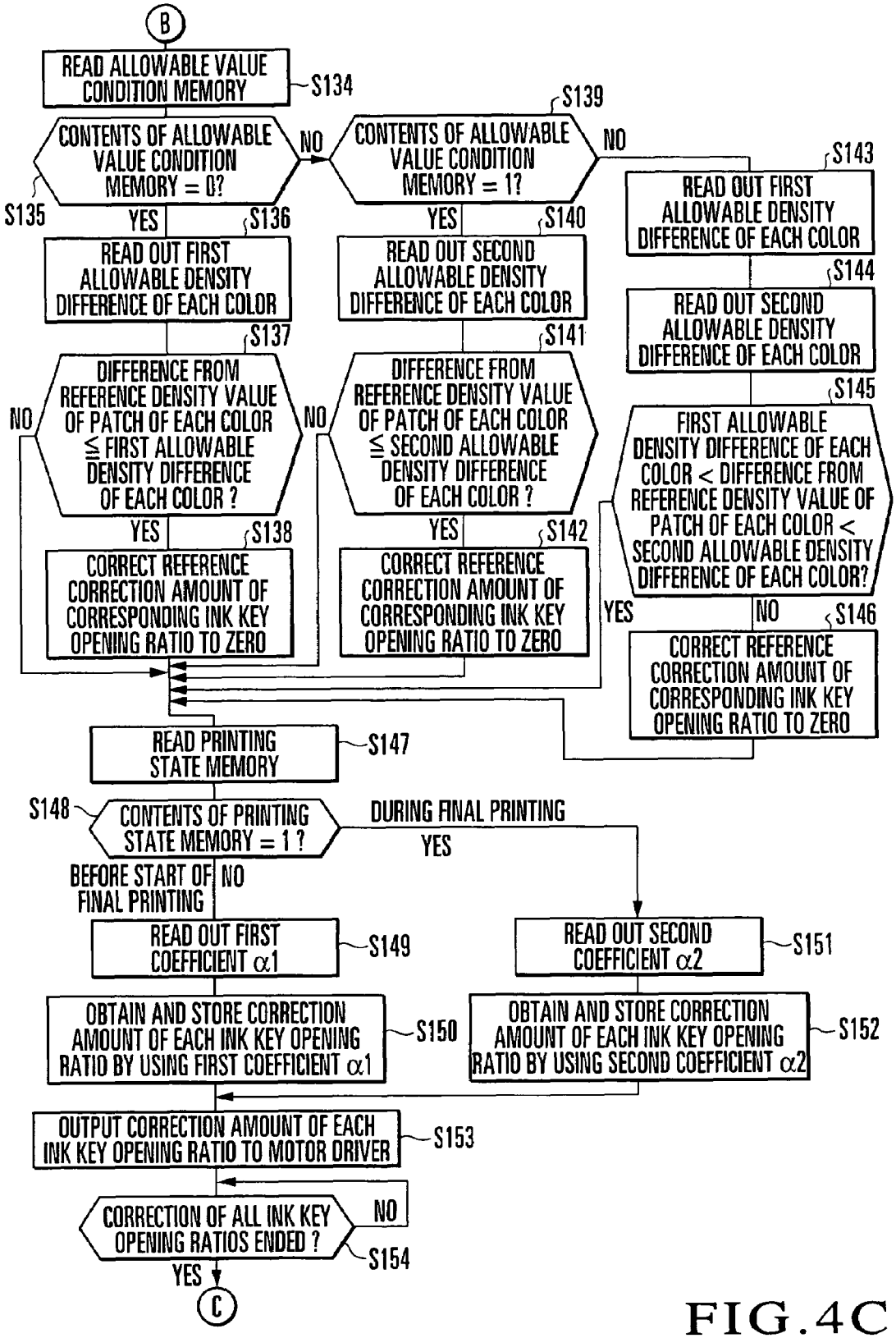
Figure 5:
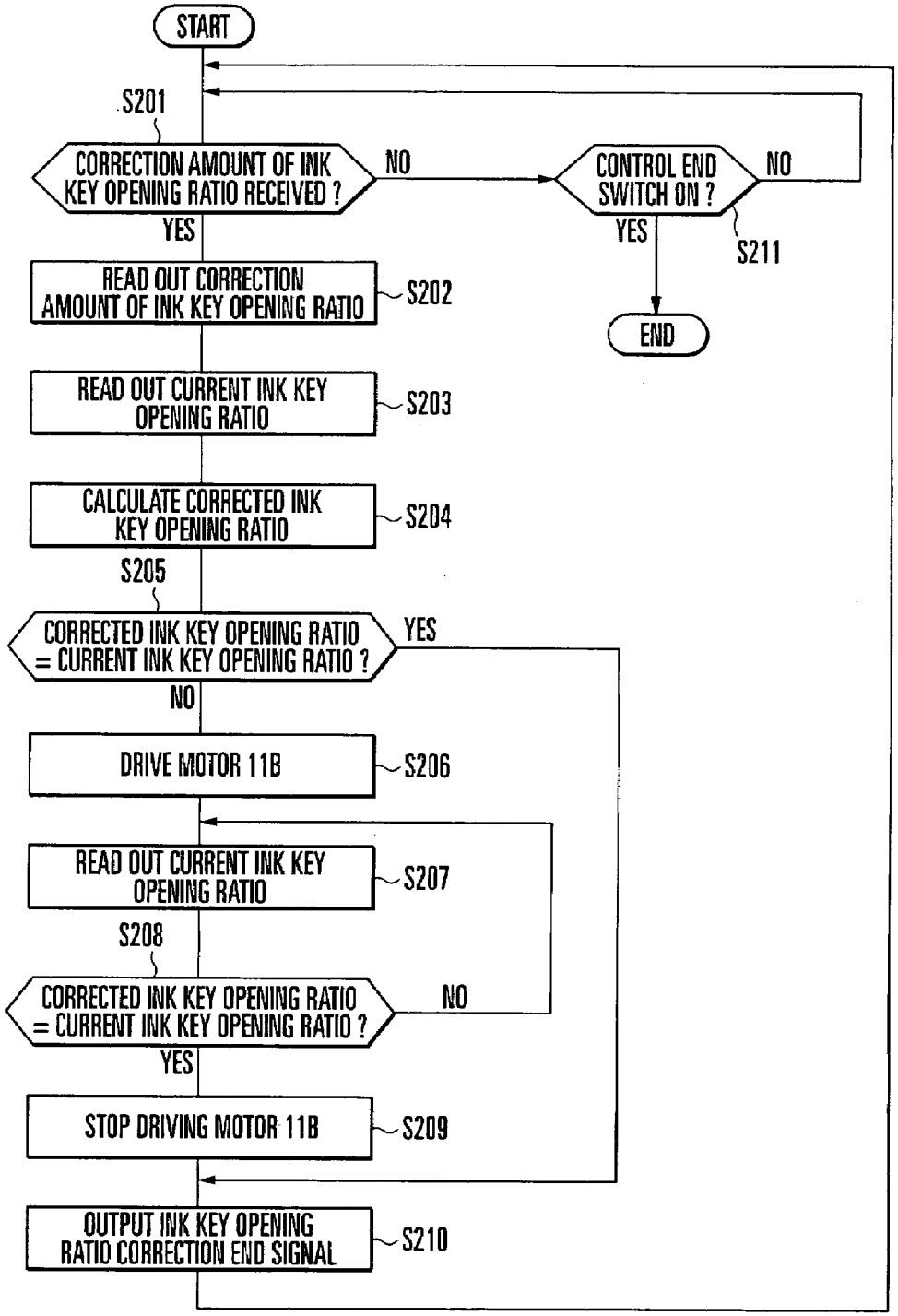
FIG. 5 is a flowchart showing the processing operation of an ink key driving motor control device shown in FIG. 1.
Figure 6:
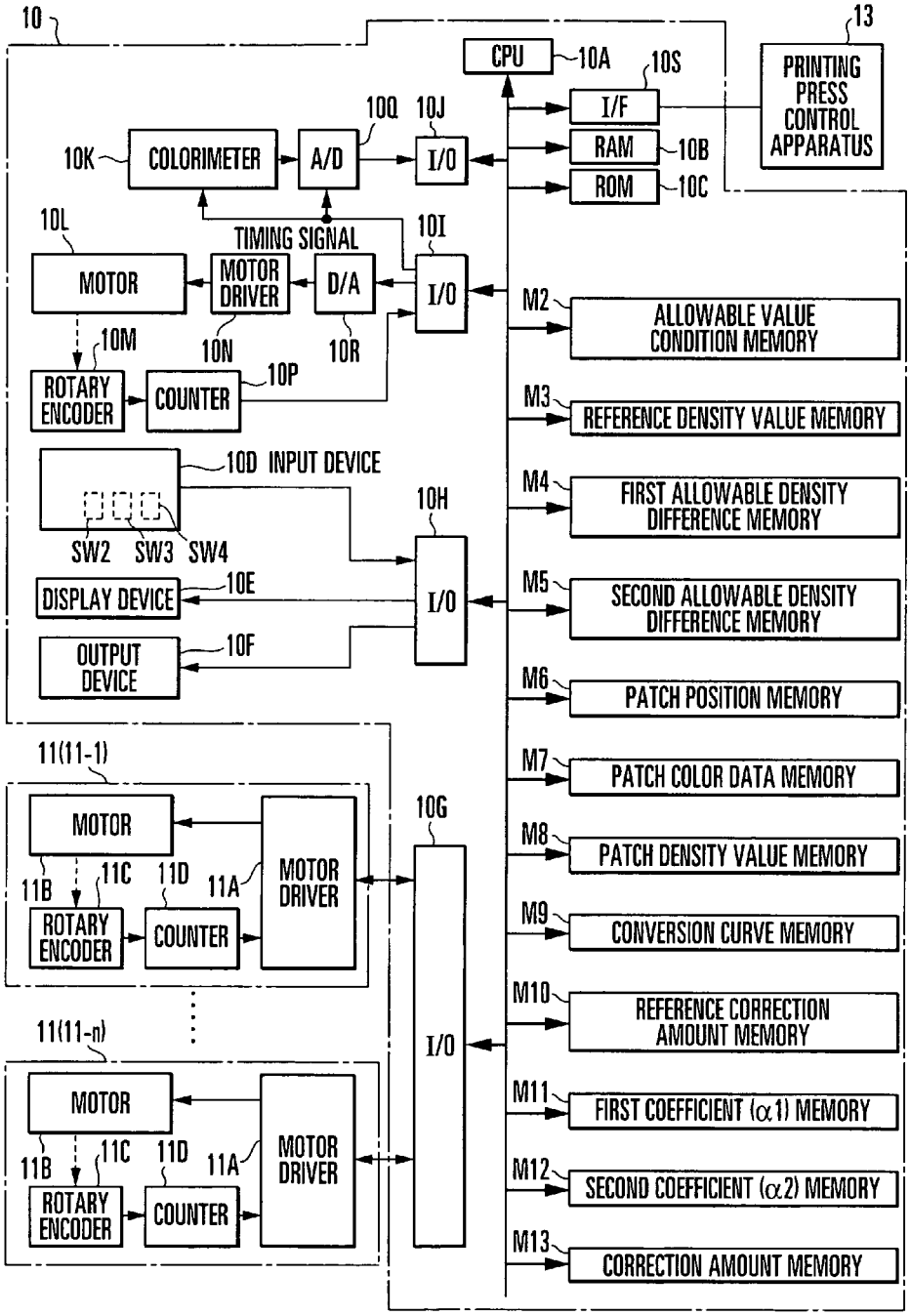
FIG. 6 is a block diagram of an ink supply amount adjustment apparatus according to the second embodiment of the present invention.

Next, the CPU 10A reads out the contents of the memory M2 (step S134 shown in FIG. 4C). When "0" is stored in the memory M2 ("YES" in step S135), the CPU 10A determines that the first allowable density difference should be used as the allowable density difference for color matching. The flow advances to step S136. When "0" is not stored in the memory M2 ("NO" in step S135), the CPU 10A determines that the first allowable density difference should not be used as the allowable density difference for color matching. The flow advances to step S139. In this case, "0" has been stored in the memory M2 in step S102. Hence, the flow advances to step S136.

In step S136, the CPU 10A reads out the first allowable density difference of each color from the memory M4. The CPU 10A compares the density difference between the measured density value of the patch 9*a* of each color and the reference density value of each color, which is calculated in step S132, with the first allowable density difference of each color (step S137). For a patch whose density difference is determined by the comparison to be equal to or smaller than the first allowable density difference ("YES" in step S137), the reference correction amount of the opening ratio of the corresponding ink key is set to zero (step S138). The flow advances to step S147. Accordingly, the reference correction amount of the opening ratio of the corresponding ink key is set to a value other than zero only when the measured density difference is larger than the first allowable density difference. Only for this ink key, the opening ratio is adjusted (the ink supply amount is adjusted), as will be described later.

In step S147, the CPU 10A reads out the contents (the printing state mode representing the relationship between final printing and color matching) stored in the memory M1. If "0" non is stored in the memory M1 as the color matching operation ("NO" in step S148), the CPU 10A determines that it is color matching before the start of final printing. The flow advances to step S149. If "1" is stored in the memory M1 ("YES" in step S148), the CPU 10A determines that it is color matching during final printing. The flow advances to step S151. In this case, "0" has been stored in the memory M1 in step S101. Hence, the CPU 10A determines that it is color matching before the start of final printing. The flow advances to step S149.

In step S149, the CPU 10A reads out the first coefficient $\alpha$1 from the memory M11. The reference correction amount of the opening ratio of each ink key is multiplied by the readout first coefficient $\alpha$1 to obtain the correction amount of the opening ratio of each ink key. The obtained correction amount is stored in the memory M13 (step S150). The obtained correction amounts of the opening ratios of the ink keys are output to the motor drivers 11A in the motor control devices 11-1 to 11-n (step S153).

In each of the motor control devices 11-1 to 11-n, upon receiving the correction amount of the opening ratio of a corresponding ink key ("YES" in step S201 shown in FIG. 5), the received correction amount is read (step S202). In addition, the current ink key opening ratio is read through the counter 11D (step S203). A corrected ink key opening ratio is calculated on the basis of the read correction amount of the ink key opening ratio from the CPU 10A and the current ink key opening ratio (step S204).

If the corrected ink key opening ratio equals the current ink key opening ratio ("YES" in step S205), the flow immediately advances to step S210 to output the ink key opening ratio correction end signal to the ink supply amount adjustment apparatus 10. If the corrected ink key opening ratio does not equal the current ink key opening ratio ("NO" in step S205), the motor 11B is driven until the corrected ink key opening ratio equals the current ink key opening ratio (steps S206 to S209). After that, the ink key opening ratio correction end signal is output to the ink supply amount adjustment apparatus 10 (step S210).

Upon receiving the ink key opening ratio correction end signals from all the motor control devices 11-1 to 11-n ("YES" in step S154 shown in FIG. 4C), the CPU 10A of the ink supply amount adjustment apparatus 10 returns to step S107 to repeat the loop of step S107→S112→S119→S120. In this loop, if the control end switch SW3 is turned on ("YES" in step S120), the processing is ended. If the density measurement start switch SW2 is turned on ("YES" in step S119), the above-described processing of color matching before the start of final printing is repeated again.

[Change of Allowable Density Difference: When Hunting Phenomenon May Occur]

The operator repeats the above-described color matching before the start of final printing until the density difference between the measured density value of each color and the reference density value of each color becomes equal to or smaller than the first allowable density difference in all the regions S1 to Sn on the printing product 9. More specifically, printing is continued for a while until the effect of adjustment of the ink supply amount appears. A new printing product 9 is sampled, and color matching is executed again. This operation is repeated.

The operator checks the result of the preceding color matching. If he/she suspects that the hunting phenomenon of the ink thickness on the paper sheet should occur, the allowable density difference is changed from the first allowable density difference to the second allowable density difference. From the next color matching, the ink supply amount is adjusted only when the measured density difference is larger than the second allowable density difference (>first allowable density difference). That is, the threshold value for adjustment of the ink supply amount is made large. Accordingly, the hunting phenomenon of the ink thickness on the paper sheet can be suppressed.

The allowable density difference is changed by operating the allowable value condition input switch SW4. The allowable value condition input switch SW4 is turned on only when it is pressed and immediately returns to the OFF state. When the allowable value condition input switch SW4 is turned on (step S112 shown in FIG. 4A), the CPU 10A reads out the contents (allowance mode) of the memory M2 (step S113).

If "0" is stored in the memory M2 ("YES" in step S114), the CPU 10A changes the contents of the memory M2 to "1" (step S116). If "0" is not stored in the memory M2 ("NO" in step S114), the flow advances to step S115. In this case, "0" has been stored in the memory M2 in step S102. Hence, the flow advances to step S116 to change the contents of the memory M2 to "1".

In this way, the allowable value condition input switch SW4 is turned on once to change the contents of the memory M2 to "1" Then, the operator turns on the density measurement start switch SW2. When the density measurement start switch SW2 is turned on ("YES" in step S119), the CPU 10A executes the processing in steps S121 to S133 shown in FIG. 4B.

In step S134 (FIG. 4C) after step S133, the CPU 10A reads out the contents of the memory M2. Since "1" is stored in the memory M2, the flow advances to step S140 because "NO" in step S135, and "YES in step S139. The CPU 10A reads out the second allowable density difference of each color from the memory M5. The CPU 10A compares the density difference between the measured density value of the patch 9*a* of each color and the reference density value of each color, which is calculated in step S132, with the second allowable density difference of each color (step S141). For a patch whose density difference is determined by the comparison to be equal to or smaller than the second allowable density difference ("YES" in step S141), the adjustment amount (reference correction amount) of the opening ratio of the corresponding ink key is set to zero (step S142). Then, the flow advances to step S147. Accordingly, the reference correction amount of the opening ratio of the corresponding ink key is set to a value other than zero only when the measured density difference is larger than the second allowable density difference. Only for this ink key, the opening ratio is adjusted (the ink supply amount is adjusted).

[Change of Allowable Density Difference: When Unexpected Accident Has Occurred]

When an unexpected accident such as paper fold error, paper breakage, or smear on the printing product has occurred, and the density value of a specific part of the printing product 9 has temporarily largely varied, the operator changes the allowable density difference range from a range equal to or smaller than the first allowable density difference to a range from the second allowable density difference to the first allowable density difference (both inclusive). Accordingly, from the next color matching, the ink supply amount is adjusted only when the measured density difference is larger than the first allowable density difference and smaller than the second allowable density difference. For this reason, even when the measured density difference exceeds the second allowable density value, the ink supply amount is not adjusted. The amount of wasted paper generated by the temporary variation in density value can be decreased.

The allowable density difference is changed by operating the allowable value condition input switch SW4. When the allowable value condition input switch SW4 is turned on (first time), the CPU 10A stores "1" in the memory M2 (step S112→S113→S114→S116). When the allowable value condition input switch SW4 is turned on again (second time), the CPU 10A stores "2" in the memory M2 (step S112→S113→S114→S115→S117).

In this way, the allowable value condition input switch SW4 is turned on twice to store "2" in the memory M2. Then, the operator turns on the density measurement start switch SW2. When the density measurement start switch SW2 is turned on ("YES" in step S119), the CPU 10A executes the processing in steps S121 to S133 shown in FIG. 4B.

In step S134 (FIG. 4C) after step S133, the CPU 10A reads out the contents of the memory M2. Since "2" is stored in the memory M2, the CPU 10A advances to step S143 because "NO" in steps S135 and S139. In step S143, the CPU 10A reads out the first allowable density difference of each color from the memory M4. In step S144, the CPU 10A also reads out the second allowable density difference of each color from the memory M5.

The CPU 10A compares the density difference between the measured density value of the patch 9*a* of each color and the reference density value of each color, which is calculated in step S132, with the first and second allowable density differences of each color (step S145). For a patch whose density difference is determined by the comparison to be equal to or smaller than the first allowable density difference or equal to or larger than the second allowable density difference ("NO" in step S145), the reference correction amount of the opening ratio of the corresponding ink key is set to zero (step S146). Then, the flow advances to step S147. Accordingly, the reference correction amount of the opening ratio of the corresponding ink key is set to a value other than zero only when the measured density difference is larger than the first allowable density difference and smaller than the second allowable density difference. Only for this ink key, the opening ratio is adjusted (the ink supply amount is adjusted).

[Color Matching During Final Printing]

To execute color matching during final printing, the operator turns on the printing state input switch SW1. The printing state input switch SW1 is turned on only when it is pressed and immediately returns to the OFF state. When the printing state input switch SW1 is turned on (step S107 shown in FIG. 4A), the CPU 10A reads out the contents of the memory M1 (step S108).

If "0" is stored in the memory M1 ("YES" in step S109), the CPU 10A changes the contents of the memory M1 to "1" (step S110). If "1" is not stored in the memory M1 ("NO" in step S109), the CPU 10A changes the contents of the memory M1 to "0" (step S111). In this case, "0" has been stored in the memory M1 in step S101. Hence, the flow advances to step S110 to change the contents of the memory M1 to "1" (a flag representing the printing state mode is set in the memory M1).

Next, the operator turns on the density measurement start switch SW2. When the start switch SW2 is turned on ("YES" in step S119), the CPU 10A executes the processing in steps S121 to S133 shown in FIG. 4B.

In step S134 (FIG. 4C) after step S133, the CPU 10A reads out the contents of the memory M2. When "0" is stored in the memory M2, the CPU 10A executes the processing in steps S136 to S138. When "1" is stored in the memory M2, the CPU 10A executes the processing in steps S140 to S142. When "2" is stored in the memory M2, the CPU 10A executes the processing in steps S143 to S146. Then, the flow advances to step S147.

In step S147, the CPU 10A reads out the contents of the memory M1. If "0" is stored in the memory M1 ("NO" in step S148), the CPU 10A determines that it is color matching before the start of final printing, and the flow advances to step S149. If "1" is stored in the memory M1 ("YES" in step S148), the CPU 10A determines that it is color matching during final printing, and the flow advances to step S151. In this case, "1" has been stored in the memory M1 in step S110. Hence, the CPU 10A determines that it is color matching during final printing, and the flow advances to step S151.

In step S151, the CPU 10A reads out the second coefficient $\alpha 2$ from the memory M12. The reference correction amount of the opening ratio of each ink key is multiplied by the readout second coefficient $\alpha 2$ to obtain the correction amount of the opening ratio of each ink key. The obtained correction amount is stored in the memory M13 (step S152). The obtained correction amounts of the opening ratios of the ink keys are output to the motor drivers 11A in the motor control devices 11-1 to 11-n (step S153).

Upon receiving the ink key opening ratio correction end signals from all the motor control devices 11-1 to 11-n ("YES" in step S154), the flow returns to step S107 to repeat the loop of step S107→S112→S119→S120. In this loop, if the control end switch SW3 is turned on ("YES" in step S120), the processing is ended. If the density measurement start switch SW2 is turned on ("YES" in step S119), the above-described processing of color matching during final printing is repeated again.

Second Embodiment

In the first embodiment, when the printing state input switch SW1 is turned on, the contents of the memory M1 are changed from "0" to "1", i.e., the flag is set, and it is determined that final printing is progressing. In the second embodiment, when the operation state of a counter which counts the number of properly printed paper sheet is an ON state, it is determined that final printing is progressing.

An ink supply amount adjustment apparatus according to the second embodiment of the present invention will be described with reference to FIGS. 6 to 9B. The same reference numerals as in the first embodiment denote the same or similar constituent elements in FIGS. 6 to 9B. In the second embodiment, a CPU 10A is connected to a printing press control apparatus 13 through an interface 10S.

Figure 7:
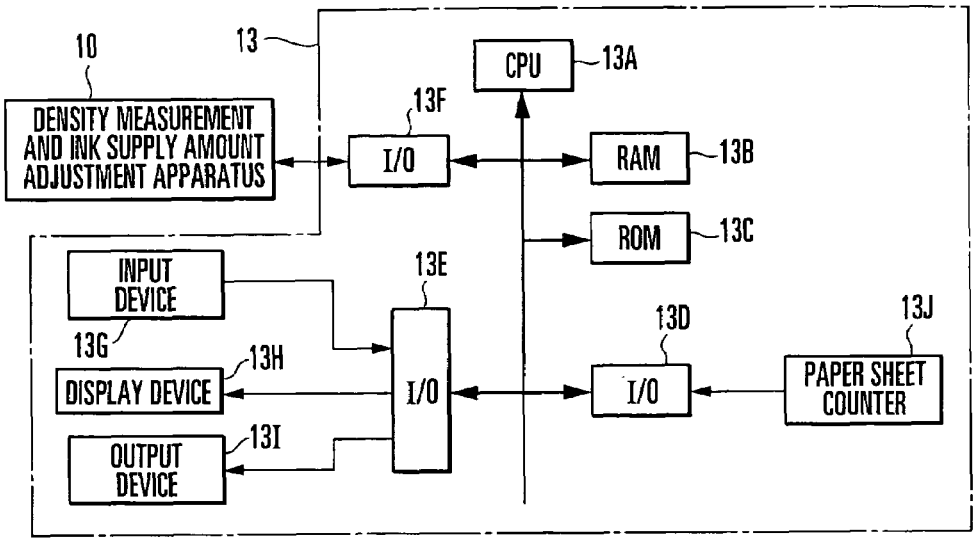
FIG. 7 is a block diagram showing the main part of a printing press control apparatus connected to the ink supply amount adjustment apparatus shown in FIG. 6.
Figure 8:
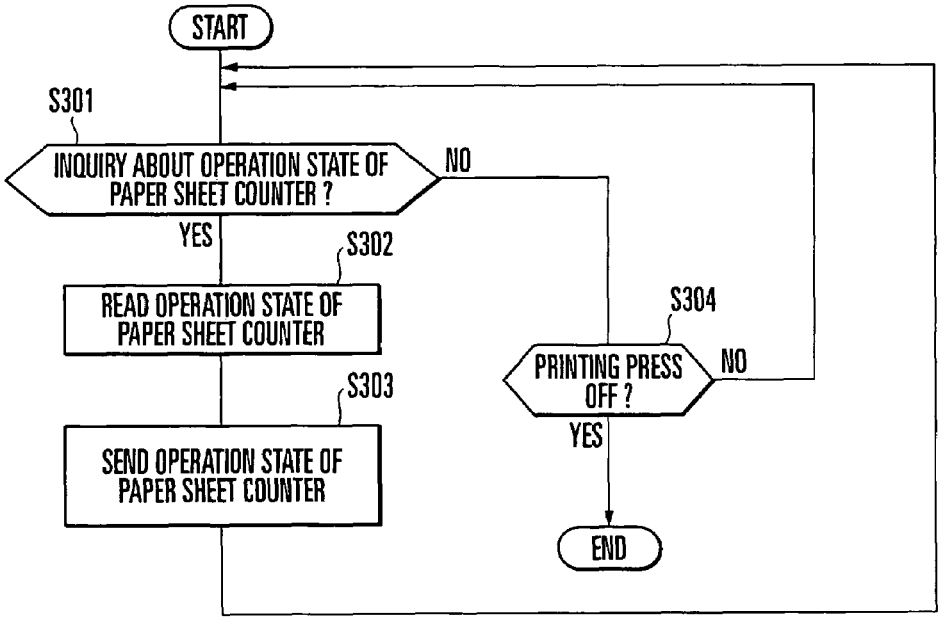
FIG. 8 is a flowchart showing the processing operation of the printing press control apparatus shown in FIG. 7 when the ink supply amount adjustment apparatus inquires about the operation state of the paper sheet counter.

As shown in FIG. 7, the printing press control apparatus 13 comprises a CPU 13A, RAM 13B, ROM 13C, input/output interfaces (I/Os) 13D to 13F, input device 13G, display device 13H, output device 13I, and paper sheet counter 13J. The paper sheet counter 13J is turned on by the operator at the start of final printing and counts the number of printing products 9 by final printing as properly printed paper sheet.

Figure 9A:
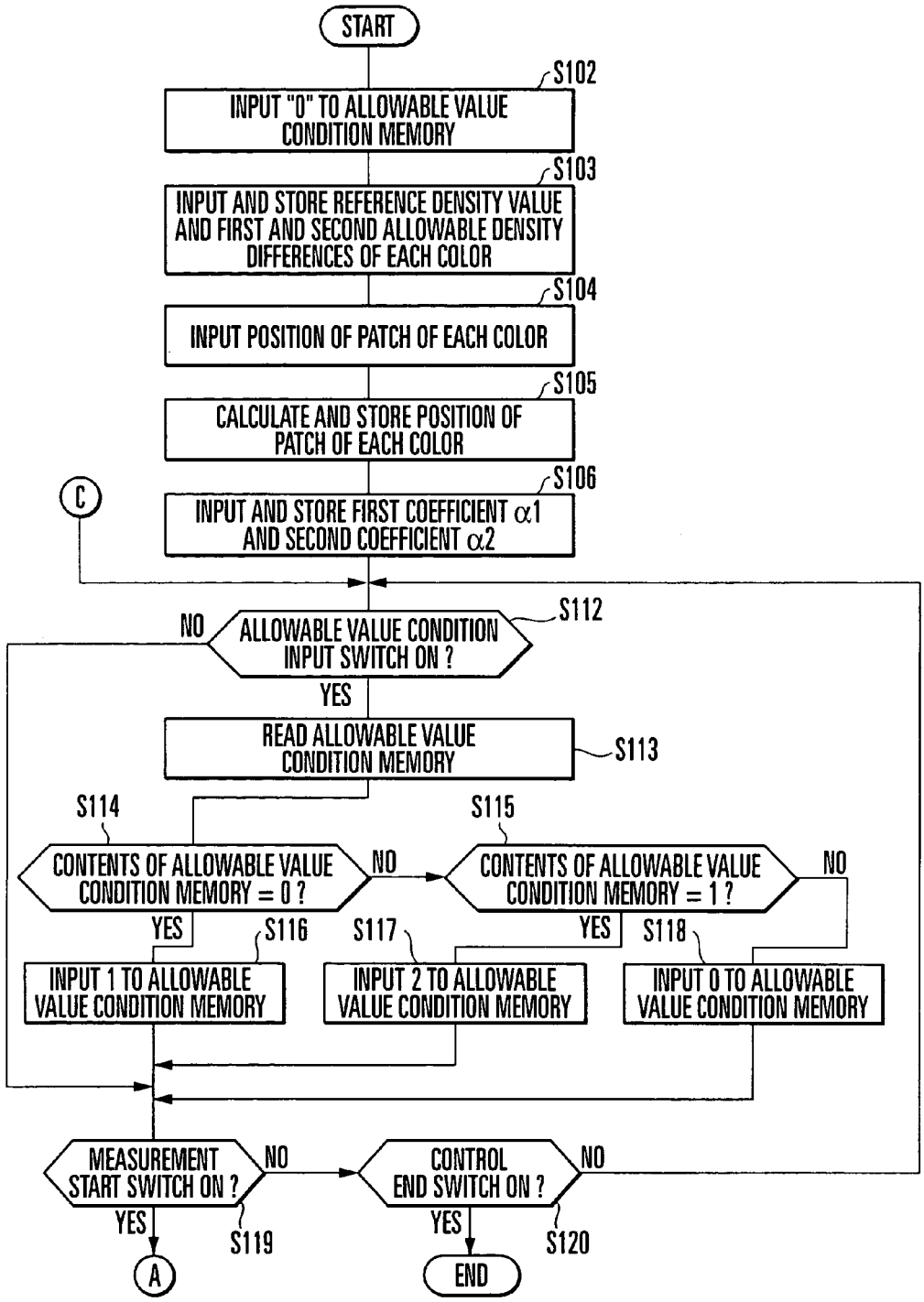
FIGS. 9A and 9B are flowcharts showing the processing operation of the ink supply amount adjustment apparatus shown in FIG. 6.
Figure 9B:
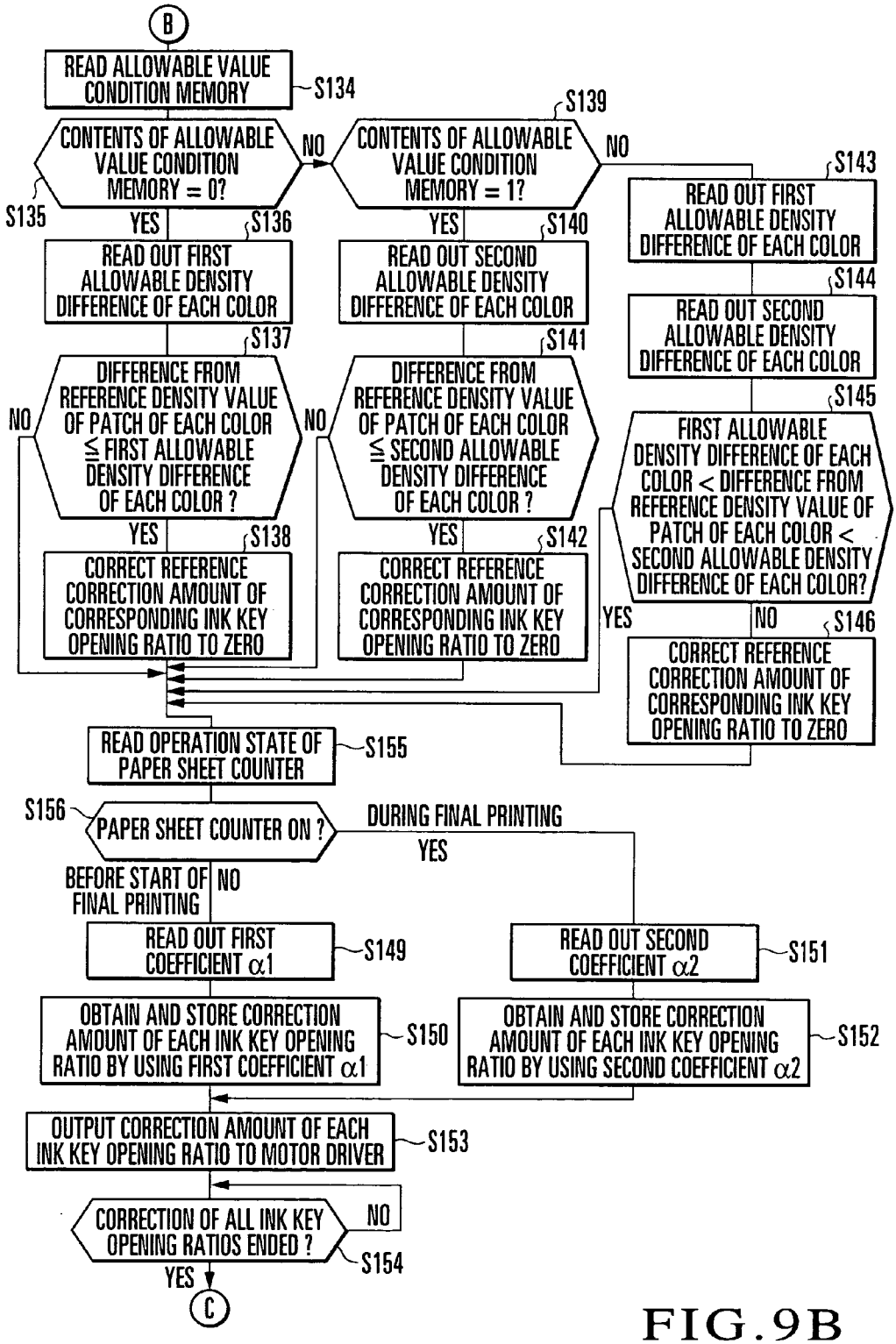
Figure 10:
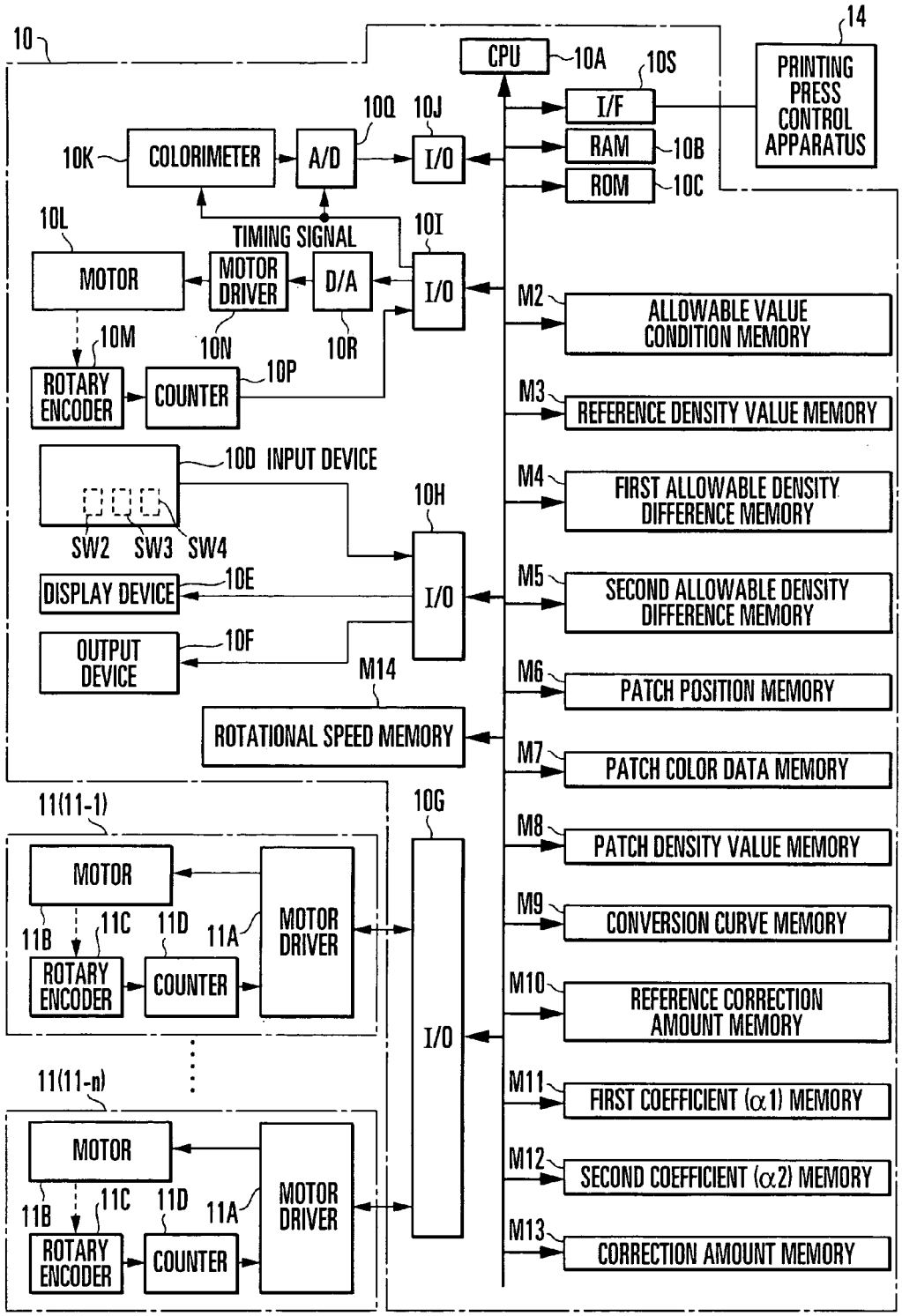
FIG. 10 is a block diagram of an ink supply amount adjustment apparatus according to the third embodiment of the present invention.

The same step numbers as in FIGS. 4A and 4C denote the same processing contents in the processing operation by the CPU 10A of an ink supply amount adjustment apparatus 10 shown in FIGS. 9A and 9B, and a description thereof will be omitted. In this processing operation, if "YES" in step S119 shown in FIG. 9A, the flow advances to step S121 shown in FIG. 4B. After step S133 shown in FIG. 4B, the flow advances to step S134 shown in FIG. 9B.

In the second embodiment, in step S155 after step S138, S142, or S146, the CPU 10A inquires of the printing press control apparatus 13 about the operation state of the paper sheet counter 13J. The processing operation of inquiring of the printing press control apparatus 13 about the operation state of the paper sheet counter 13J will be described below with reference to FIG. 8.

Upon receiving the inquiry from the CPU 10A of the ink supply amount adjustment apparatus 10 ("YES" in step S301), the printing press control apparatus 13 reads the operation state of the paper sheet counter 13J (step S302). The read operation state of the paper sheet counter 13J is sent to the CPU 10A of the ink supply amount adjustment apparatus 10 (step S303).

Upon receiving the operation state of the paper sheet counter 13J from the printing press control apparatus 13 (step S155), the CPU 10A of the ink supply amount adjustment apparatus 10 determines whether the paper sheet counter 13J is in an ON state or OFF state (step S156). If the paper sheet counter 13J is in an: OFF state ("NO" in step S156), the CPU 10A determines. that it is color matching before the start of final printing. The flow advances to step S149 to read out a first coefficient $\alpha 1$ from a memory M11. If the paper sheet counter 13J is in an ON state ("YES" in step S156), the CPU 10A determines that it is color matching during final printing. The flow advances to step S151 to read out a second coefficient $\alpha 2$ from a memory M12.

Third Embodiment

In the third embodiment, when the rotational speed of the printing press exceeds a predetermined value (the minimum rotational speed of the printing press in final printing), it is determined that final printing is progressing.

An ink supply amount adjustment apparatus according to the third embodiment of the present invention will be described with reference to FIGS. 10 to 13B. The same reference numerals as in the first embodiment denote the same or similar constituent elements in FIGS. 10 to 13B. In the third embodiment, a CPU 10A is connected to a printing press control apparatus 14 through an interface 10S. The ink supply amount adjustment apparatus further comprises a rotational speed memory M14 in addition to memories M2 to M13. The rotational speed memory M14 stores an arbitrary rotational speed of the printing press at. which the coefficient should be switched (the minimum rotational speed of the printing press in final printing: a set rotational speed Ns).

Figure 11:
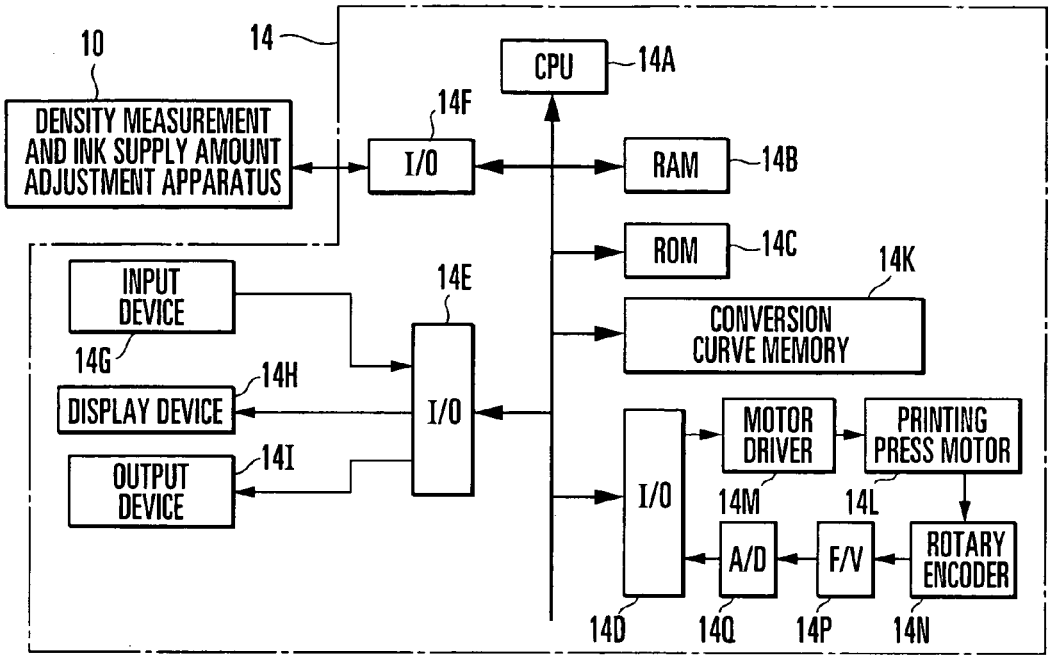
FIG. 11 is a block diagram showing the main part of a printing press control apparatus connected to the ink supply amount adjustment apparatus shown in FIG. 10.
Figure 12:
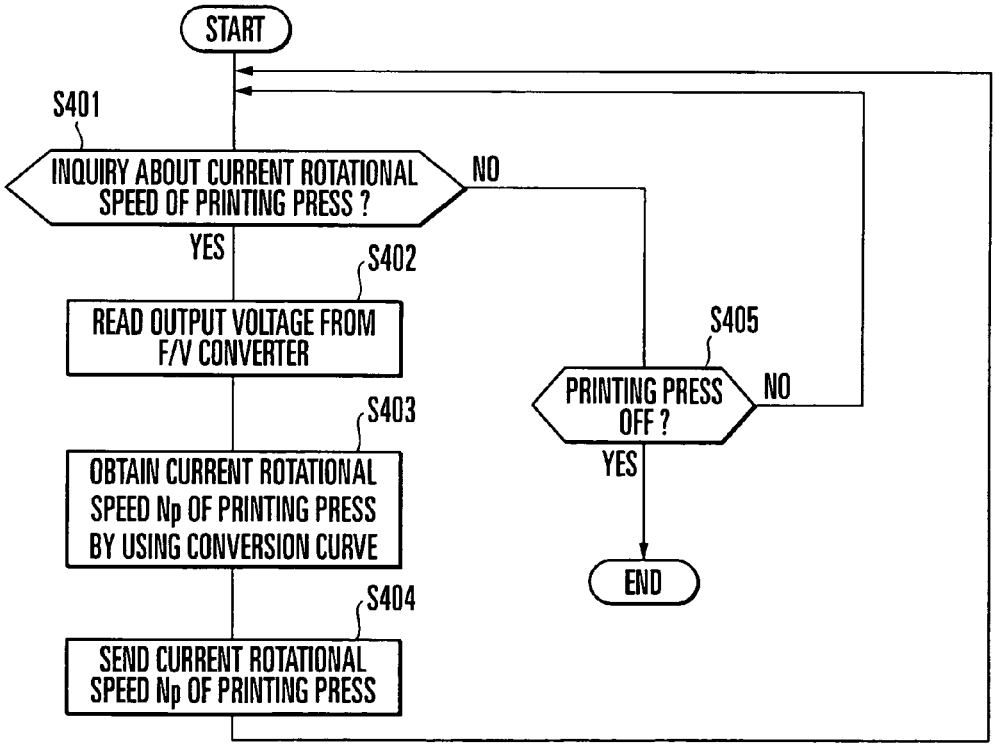
FIG. 12 is a flowchart showing the processing operation of the printing press control apparatus shown in FIG. 11 when the ink supply amount adjustment apparatus inquires about the current rotational speed of the printing press.

As shown in FIG. 11, the printing press control apparatus 14 comprises a CPU 14A, RAM 14B, ROM 14C, input/output interfaces (I/Os) 14D to 14F, input device 14G, display device 14H, output device 14I, conversion curve memory 14K, motor 14L of the printing press, motor driver 14M of the printing press, rotary encoder 14N, F/V (Frequency-to-Voltage) converter 14P and A/D converter 14Q. The conversion curve memory 14K stores the voltage-to-printing press rotational speed conversion curve. The rotary encoder 14N generates a rotation pulse for each predetermined number of revolutions (angle) of the motor 14L and sends the pulse to the F/V converter 14P. The F/V converter 14P converts the frequency of the rotation pulse from the rotary encoder 14N into a voltage value.

Figure 13A:
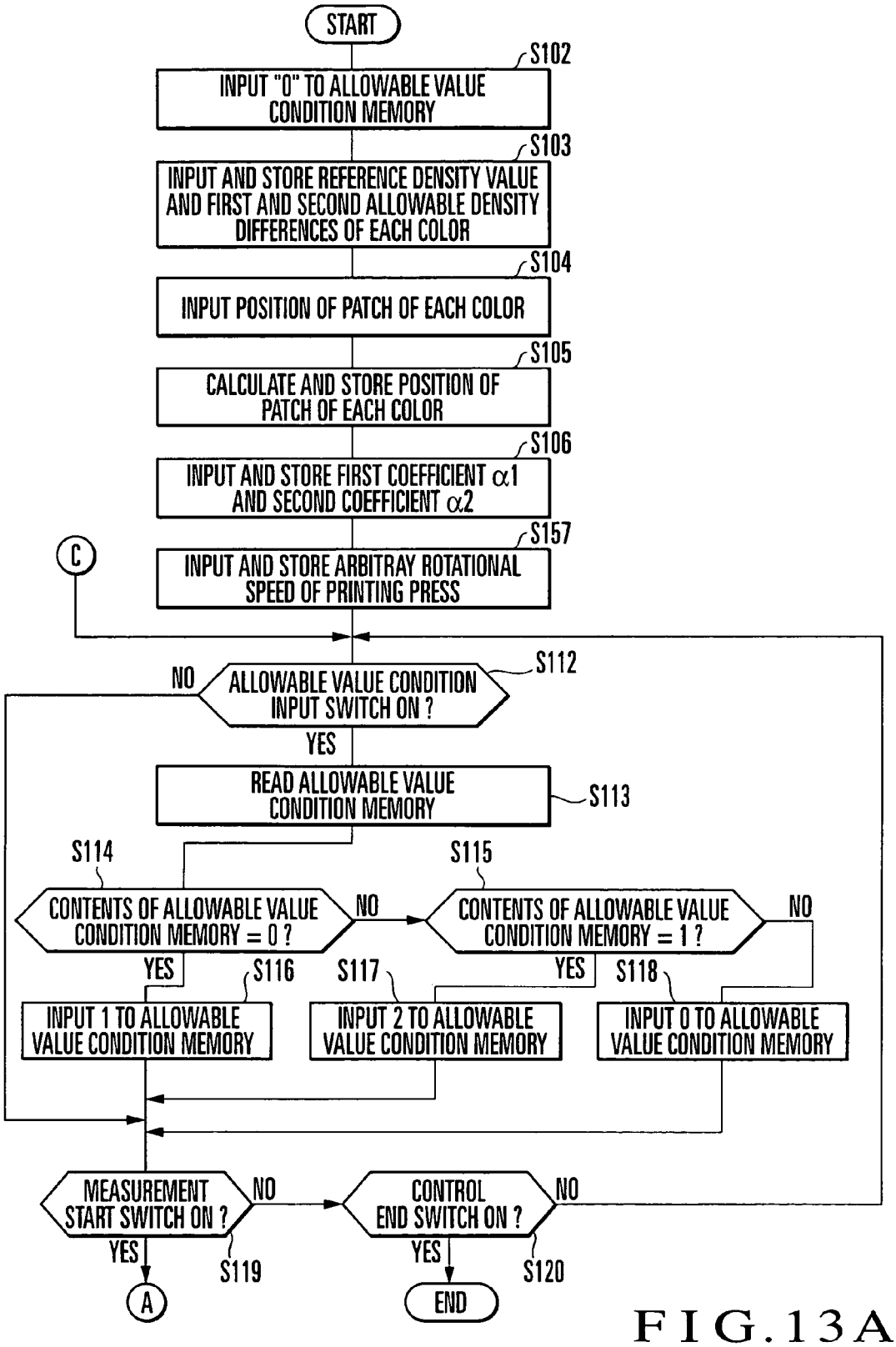
FIGS. 13A and 13B are flowcharts showing the processing operation of the ink supply amount adjustment apparatus shown in FIG. 10.
Figure 13B:
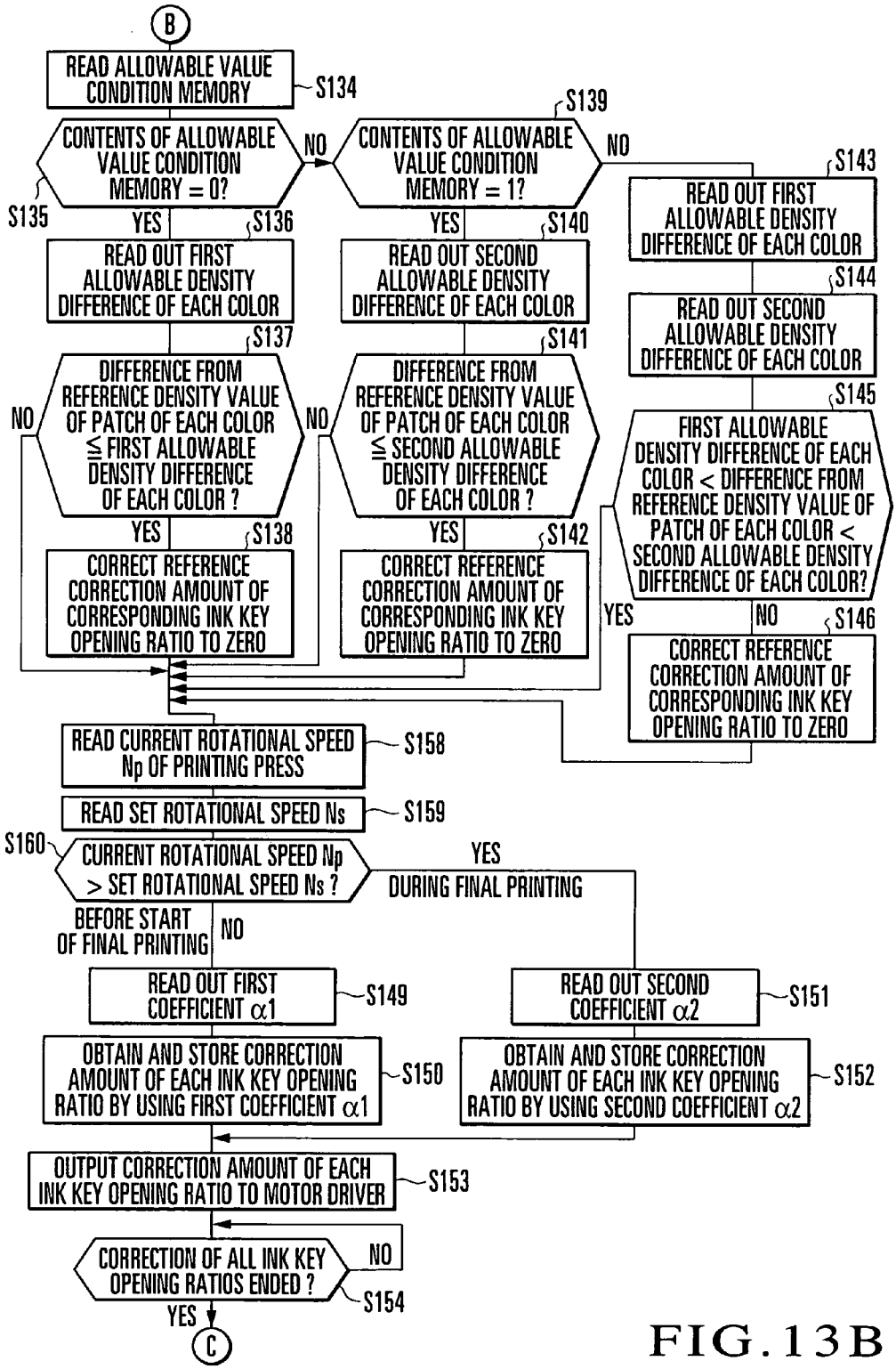

The same step numbers as in FIGS. 4A and 4C denote the same processing contents in the processing operation by the CPU 10A of an ink supply amount adjustment apparatus 10 shown in FIGS. 13A and 13B, and a description thereof will be omitted. In this processing operation, if "YES" in step S119 shown in FIG. 13A, the flow advances to step S121 shown in FIG. 4B. After step S133 shown in FIG. 4B, the flow advances to step S134 shown in FIG. 13B.

In the third embodiment, in step S157 after step S106, the operator inputs the minimum rotational speed of the printing press in final printing as the set rotational speed Ns of the printing press to switch the coefficient. The CPU 10A stores the input set rotational speed Ns in the memory M14. In step S158 after step S138, S142, or S146, the CPU 10A inquires of the printing press control apparatus 14 about the current rotational speed of the printing press. The processing operation of inquiring of the printing press control apparatus 14 about the current rotational speed of the printing press will be described below with reference to FIG. 12.

Upon receiving the inquiry from the CPU 10A of the ink supply amount adjustment apparatus 10 ("YES" in step S401 shown in FIG. 12), the printing press control apparatus 14 reads the output voltage from the F/V converter 14P (step S402). Next, the rotational speed corresponding to the output voltage from the F/V converter 14P is obtained as a current rotational speed Np by using the voltage-to-printing press rotational speed conversion table stored in the conversion curve memory 14K (step S403). The obtained current rotational speed Np is sent to the CPU 10A of the ink supply amount adjustment apparatus 10 (step S404).

The CPU 10A of the ink supply amount adjustment apparatus 10 reads the current rotational speed Np from the printing press control apparatus 14 (step S158) and then reads out the set rotational speed Ns stored in the memory M14 (step S159). The current rotational speed Np is compared with the set rotational speed Ns. If $Np \leqq Ns$ ("NO" in step S160), the CPU 10A determines that it is color matching before the start of final printing. The flow advances to step S149 to read out a first coefficient $\alpha 1$. If $Np > Ns$ ("YES" in step S160), the CPU 10A determines that it is color matching during final printing. The flow advances to step S151 to read out a second coefficient $\alpha 2$.

Fourth Embodiment

In the fourth embodiment, the difference between the precedingly measured average density value of a patch 9*a* of each color in a color bar 9-2 and the currently measured average density value of the patch 9*a* of each color in the color bar 9-2 is calculated. When the difference is smaller than a predetermined value (set density difference), it is determined that final printing is progressing.

Figure 14:
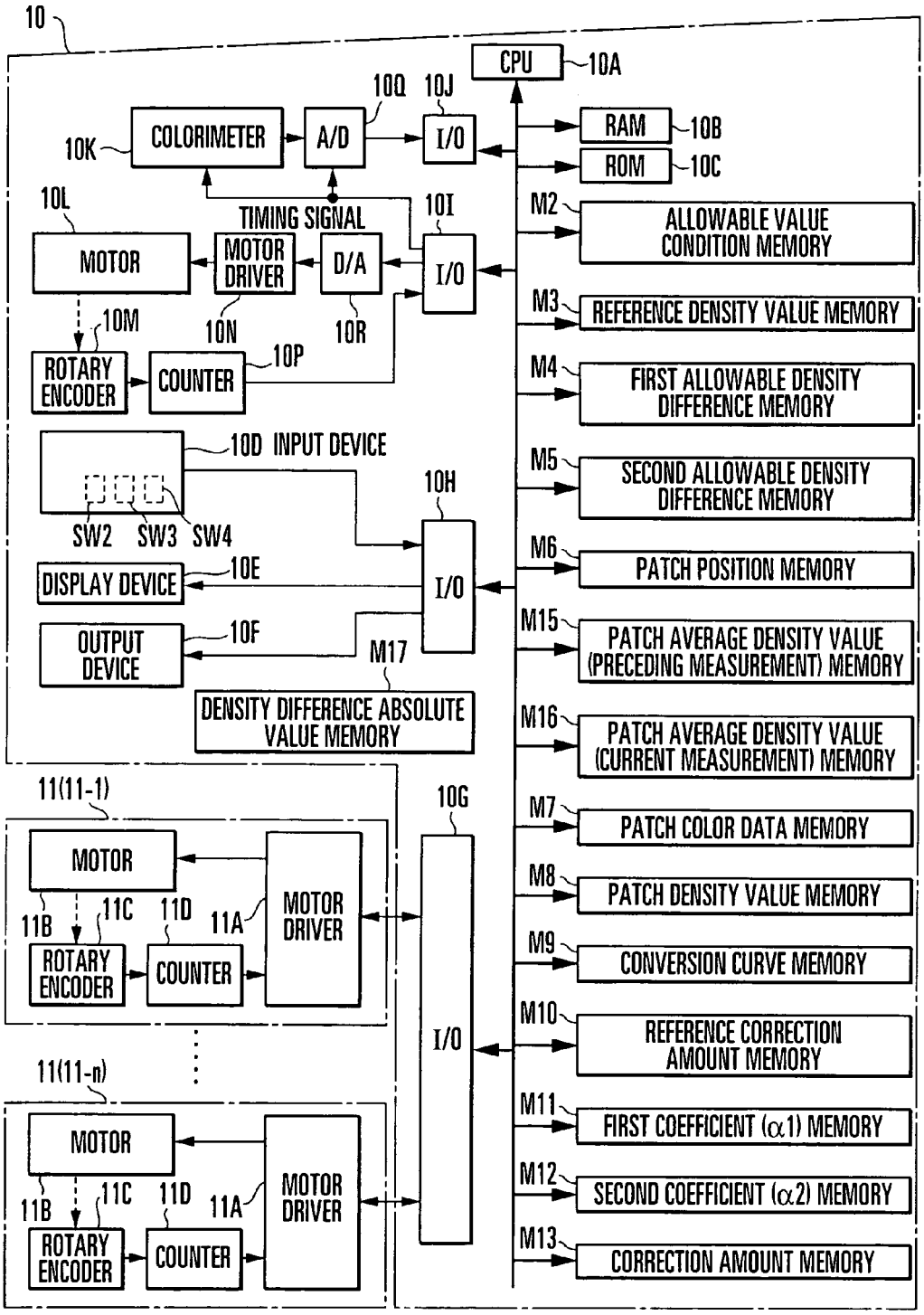
FIG. 14 is a block diagram of an ink supply amount adjustment apparatus according to the fourth embodiment of the present invention.

An ink supply amount adjustment apparatus according to the fourth embodiment of the present invention will be described with reference to FIGS. 14 to 15B. The same reference numerals as in the first embodiment denote the same or similar constituent elements in FIGS. 14 to 15B. In the fourth embodiment, the ink supply amount adjustment apparatus further comprises memories M15, M16, and M17 in addition to memories M2 to M13. The memories M15, M16, and M17 store the precedingly and currently measured average density value of the patch of each color in the color bar.

Figure 15A:
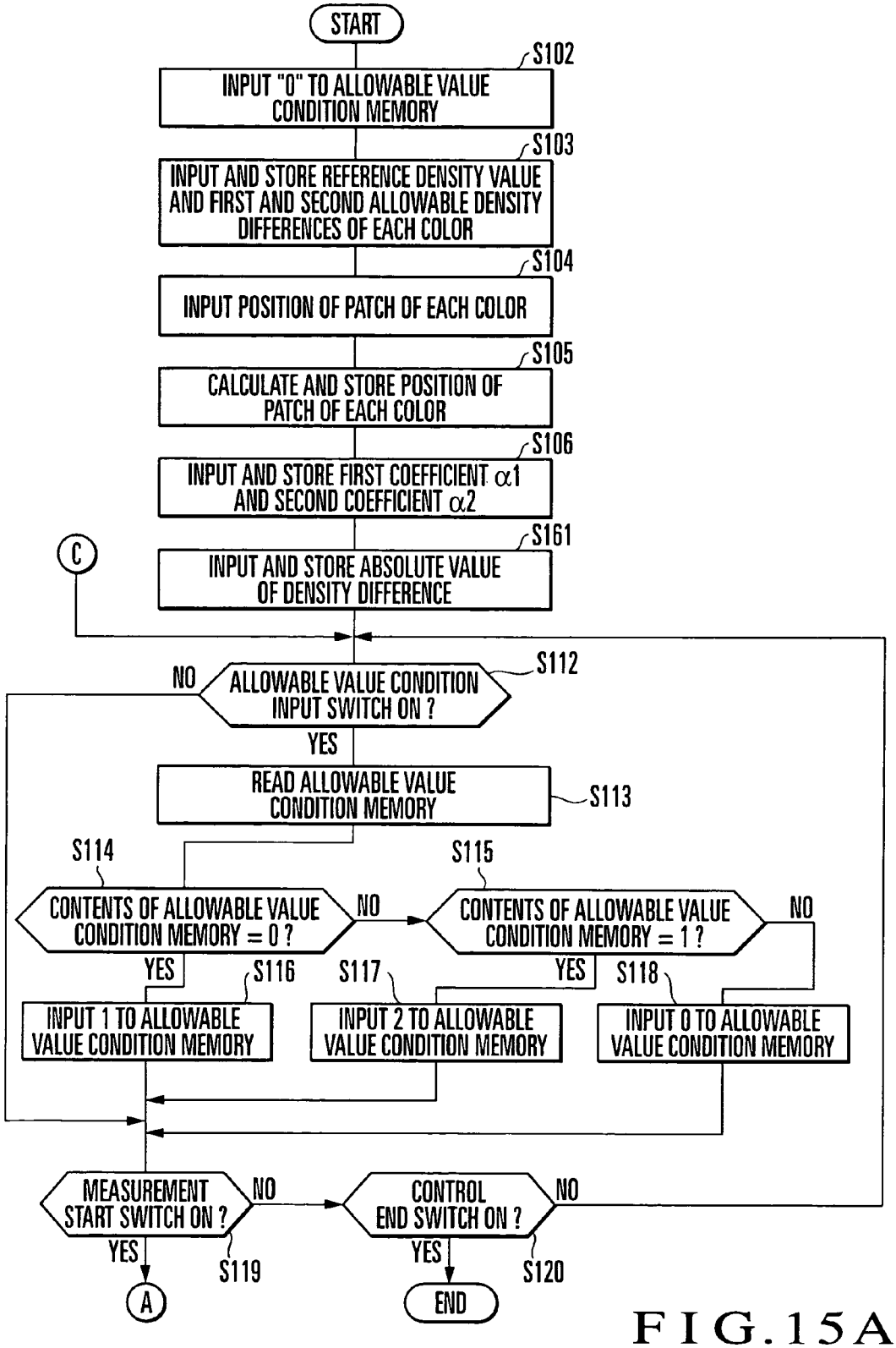
FIGS. 15A and 15B are flowcharts showing the processing operation of the ink supply amount adjustment apparatus shown in FIG. 14.
Figure 15B:
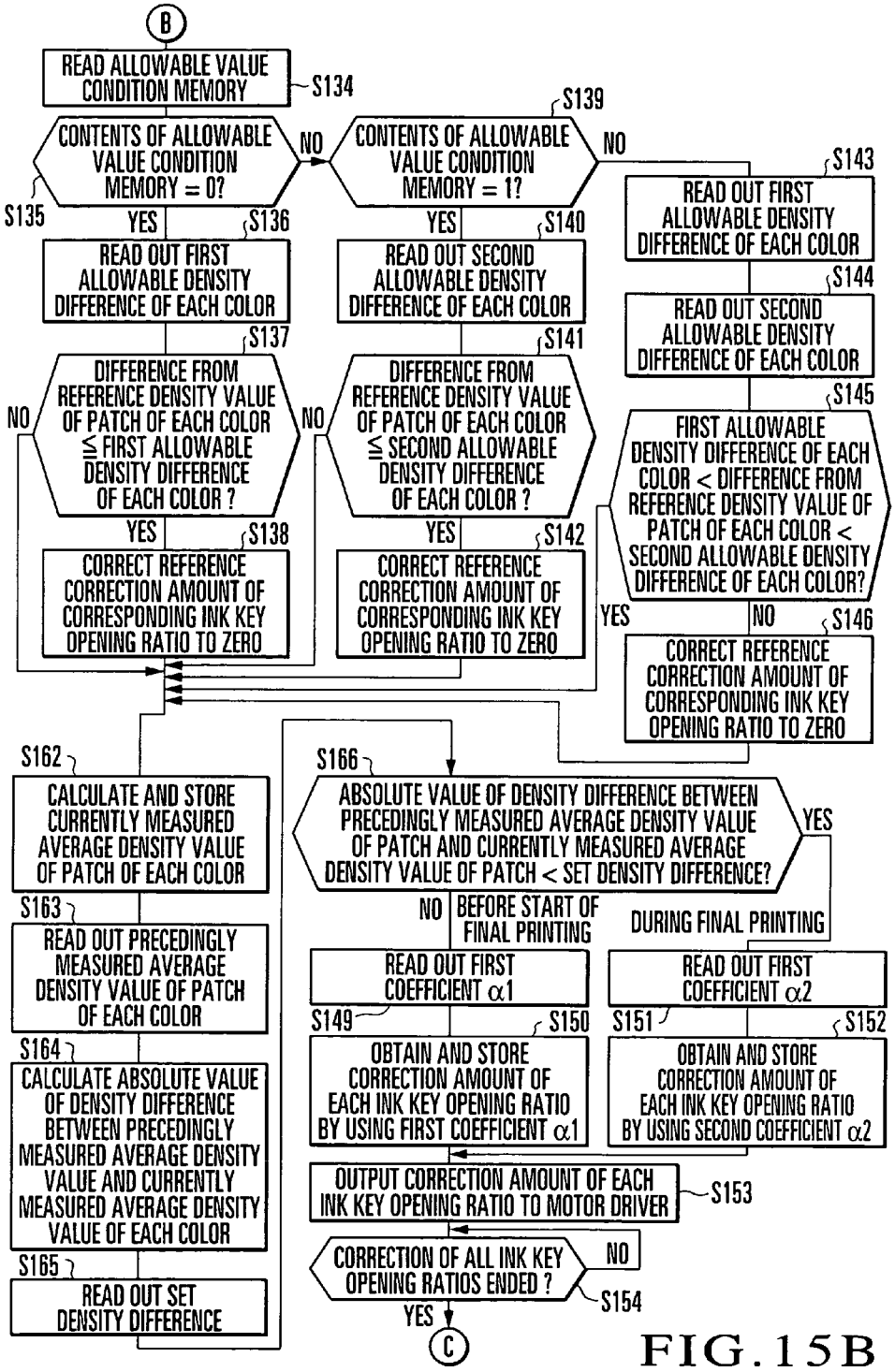

The same step numbers as in FIGS. 4A and 4C denote the same processing contents in FIGS. 15A and 15B which explain the processing operation executed by a CPU 10A of an ink supply amount adjustment apparatus 10, and a description thereof will be omitted. In this processing operation, if "YES" in step S119 shown in FIG. 15A, the flow advances to step S121 shown in FIG. 4B. After step S133 shown in FIG. 4B, the flow advances to step S134 shown in FIG. 15B.

In the fourth embodiment, in step S161 after step S106, the operator inputs the set density difference of each color to switch the coefficient. The CPU 10A stores the input set density difference of each color in the memory M17.

In step S162 after step S138, S142, or S146, the CPU 10A obtains the average density value of each color on the basis of the density value of the density measurement patch 9*a* of each color in the color bar 9-2. The obtained average density value is stored in the memory M16 as the currently measured average density value of the patch 9*a* of each color in the color bar 9-2. The precedingly measured average density value of the patch 9*a* of each color in the color bar 9-2 is read out from the memory M15 (step S163). For each color, the absolute value of the density difference between the precedingly measured average density value of the patch 9*a* in the color bar 9-2 and the currently measured average density value of the patch 9*a* in the color bar 9-2 is calculated (step S164).

The set density difference of each color is read out from the memory M17 (step S165). It is determined for all colors whether the absolute value of the density difference between the precedingly measured average density value of the patch 9*a* in the color bar 9-2 and the currently measured average density value of the patch 9*a* in the color bar 9-2 is smaller than the set density difference (step S166).

If the absolute value of the density difference between the precedingly measured average density value of the patch 9*a* in the color bar 9-2 and the currently measured average density value of the patch 9*a* in the color bar 9-2 is smaller than the set density difference for all colors ("YES" in step S166), the CPU 10A determines that it is color matching during final printing. The flow advances to step S151 to read out a second coefficient $\alpha 2$. If the absolute value of the density difference is larger than the set density difference for at least one color ("NO" in step S166), the CPU 10A determines that it is color matching before the start of final printing. The flow advances to step S149 to read out a first coefficient $\alpha 1$.

Fifth Embodiment

In the first embodiment, the first and second allowable density differences used in color matching before the start of final printing are the same as those used for color matching during final printing. In color matching before the start of final printing, the ink amount in the inker is often largely different from the ink amount necessary for a printing product to be printed. Hence, the measured density difference is large. To the contrary, in color matching during final printing, the ink amount in the inker is not so different from the ink amount necessary for a printing product to be printed. Hence, the measured density difference is small. In the fifth embodiment, the first and second allowable density differences for color matching during final printing are set independently of those for color matching before the start of final printing. The first and second allowable density differences for color matching during final printing are set smaller than those for color matching before the start of final printing.

An ink supply amount adjustment apparatus according to the fifth embodiment of the present invention will be described with reference to FIGS. 16 to 17D. The same reference numerals as in FIG. 1 denote the same or similar constituent elements in FIGS. 16 to 17D. In the fifth embodiment, an input device 10D comprises an allowable value condition input switch SW41 for color matching before the start of final printing and an allowable value condition input switch SW42 for color matching during final printing. The ink supply amount adjustment apparatus also comprises memories M21 and M22 as allowable value condition memories. The memory M21 stores the allowable value condition for color matching before the start of final printing. The memory M22 stores the allowable value condition for color matching during final printing. The apparatus also comprises memories M41 and M42 as first allowable density difference memories for each color. The memory M41 stores the first allowable density difference of each color for color matching before the start of final printing. The memory M42 stores the first allowable density difference of each color for color matching during final printing. The apparatus also comprises memories M51 and M52 as second allowable density difference memories for each color. The memory M51 stores the second allowable density difference of each color for color matching before the start of final printing. The memory M52 stores the second allowable density difference of each color for color matching during final printing.

Figure 17A:
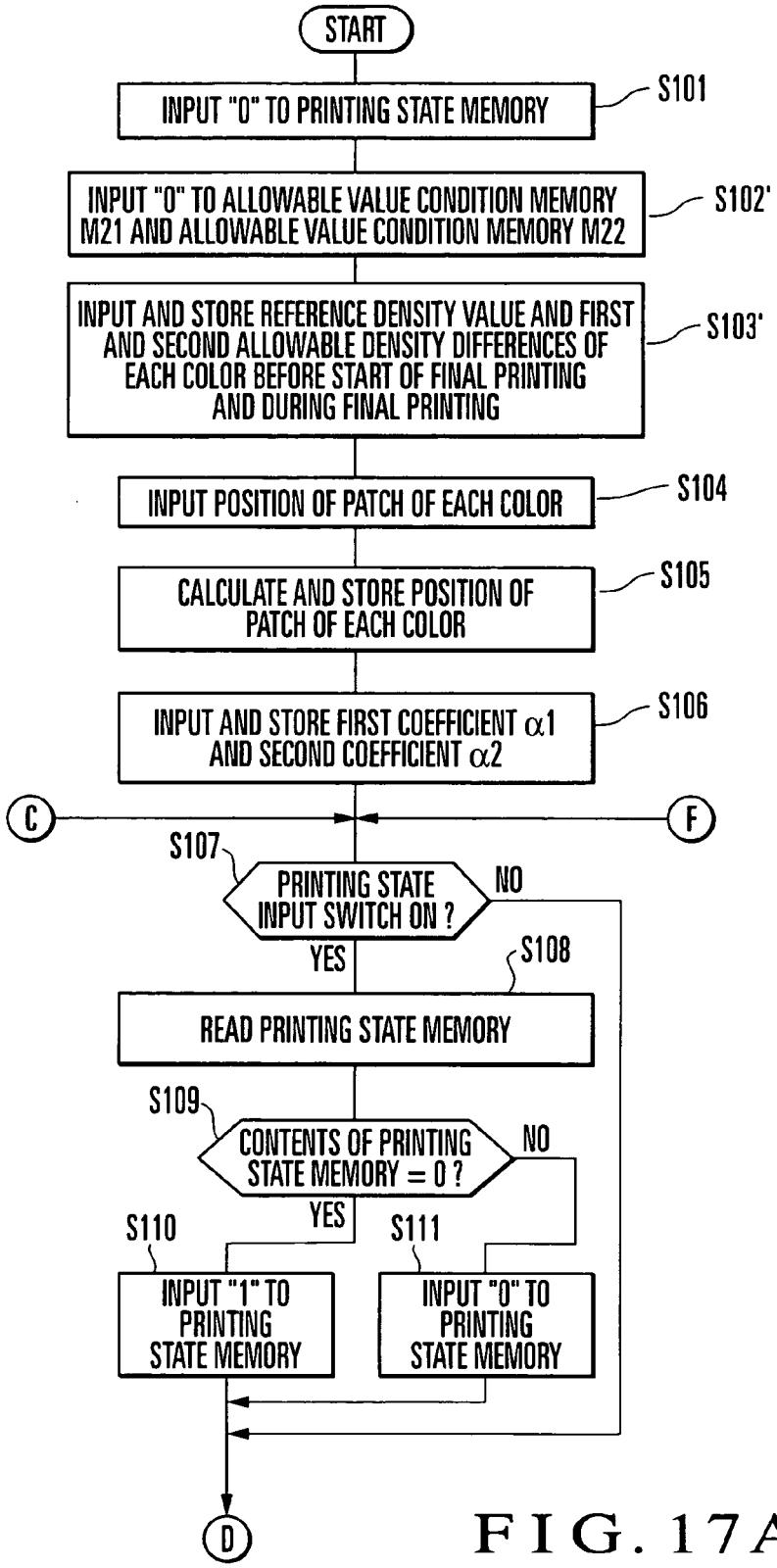
FIGS. 17A to 17D are flowcharts showing the processing operation of the ink supply amount adjustment apparatus shown in FIG. 16.
Figure 17B:
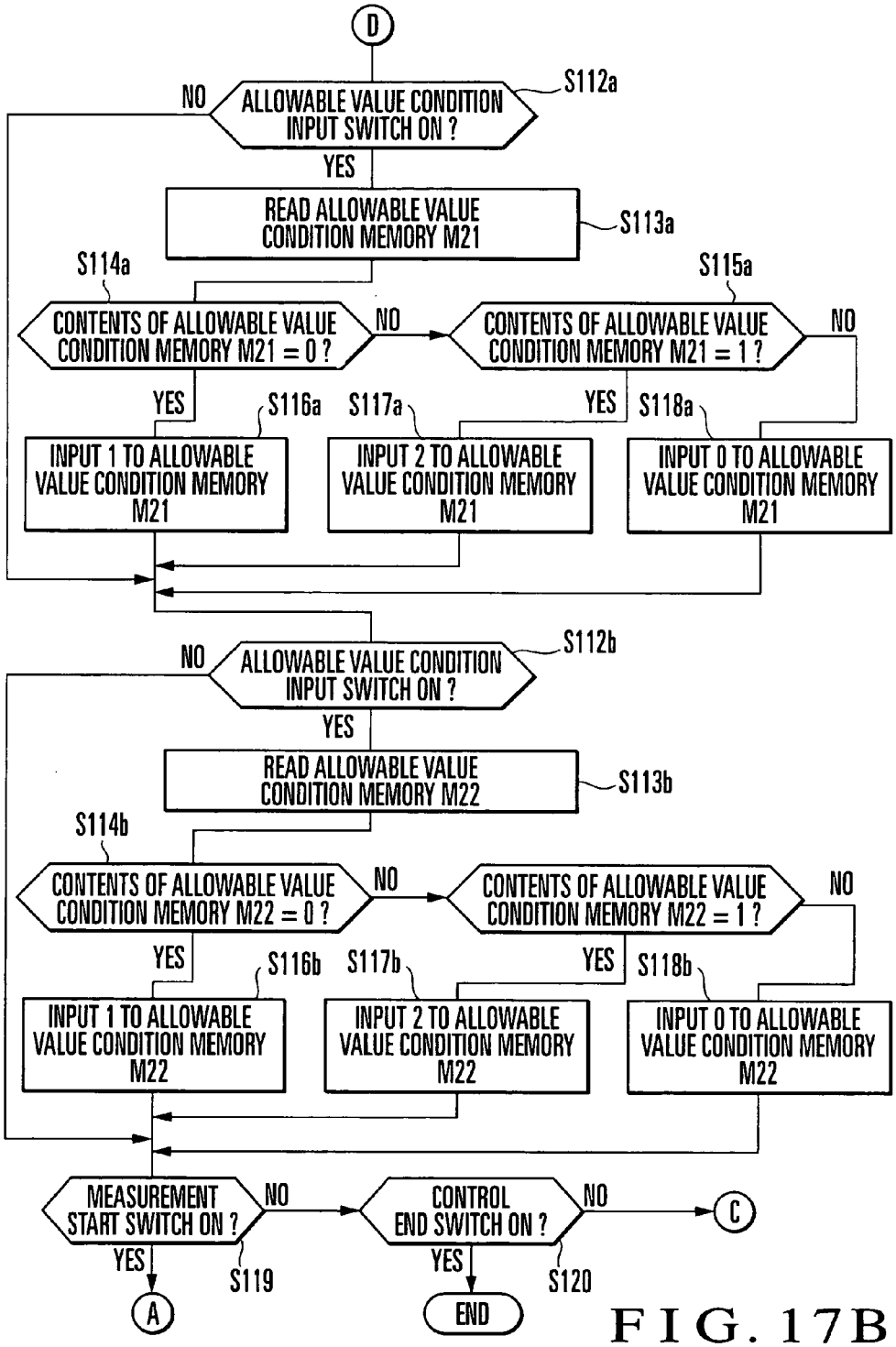
Figure 17C:
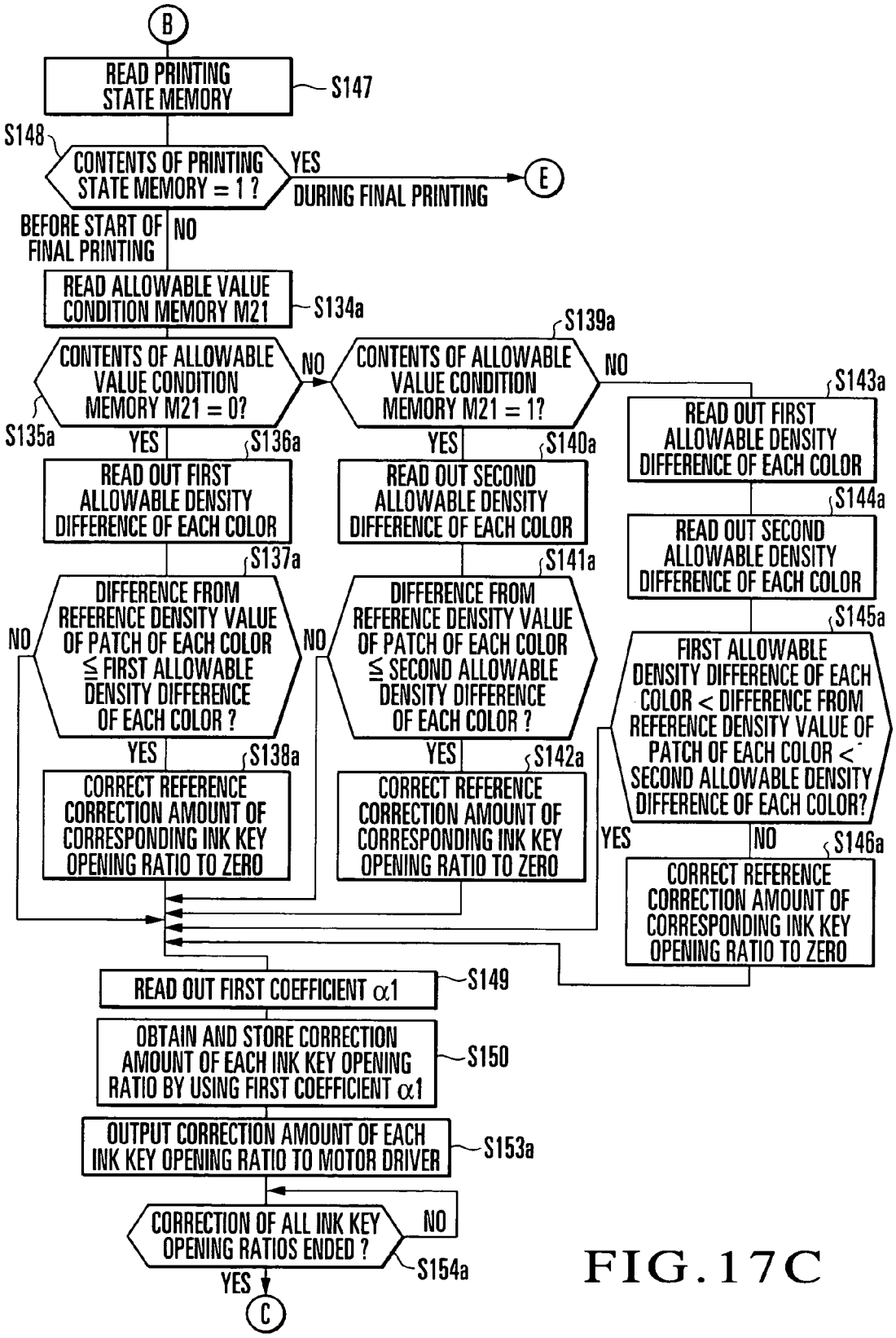

The same step numbers as in FIGS. 4A and 4C denote the same processing contents in FIGS. 17A to 17C which explain the processing operation executed by a CPU 10A of an ink supply amount adjustment apparatus 10, and a description thereof will be omitted. In this processing operation, if "YES" in step S119 shown in FIG. 17B, the flow advances to step S121 shown in FIG. 4B. After step S133 shown in FIG. 4B, the flow advances to step S147 shown in FIG. 17C.

In the fifth embodiment, in step S103', the operator inputs the reference density value of each color, the first and second allowable density differences for color matching before the start of final printing, and the first and second allowable density differences for color matching during final printing. In this case, the first and second allowable density differences for color matching during final printing are input as values smaller than those for color matching before the start of final printing. The input first and second allowable density differences for color matching before the start of final printing are stored in the memories M41 and M51, respectively. The input first and second allowable density differences for color matching during final printing are stored in the memories M42 and M52, respectively.

[Change of Allowable Density Difference for Color Matching Before Start of Final Printing]

First, "0" is stored in the allowable value condition memory M21 for color matching before the start of final printing. In step S112*a*, when the allowable value condition input switch SW41 for color matching before the start of final printing is turned on once, "1" is stored in the allowable value condition memory M21 for color matching before the start of final printing (step S112*a*→S113*a*→S114*a*→S116*a*). When the allowable value condition input switch SW41 for color matching before the start of final printing is turned on twice, "2" is stored in the allowable value condition memory M21 for color matching before the start of final printing (step S112*a*→S113*a*→S114*a*→S115*a*→S117*a*).

When a density measurement start switch SW2 is turned on ("YES" in step S119), the CPU 10A executes the processing in steps S121 to S133 shown in FIG. 4B. In step S147 (FIG. 17C) after step S133, the CPU 10A reads out the contents of a memory M1. If "0" is stored in the memory M1 ("NO" in step S148), the CPU 10A determines that it is color matching before the start of final printing, and the flow advances to step S134*a*. If "1" is stored in the memory M1 ("YES" in step S148), the CPU 10A determines that it is color matching during final printing, and the flow advances to step S134*b* (FIG. 17D). In this case, "0" has been stored in step S101. Hence, the CPU 10A determines that it is color matching before the start of final printing, and the flow advances to step S134*a*.

In step S134*a*, the CPU 10A reads out the contents of the allowable value condition memory M21 for color matching before the start of final printing. If "0" is stored in the memory M21, the CPU 10A executes processing in steps S136*a* to S138*a*. If "1" is stored in the memory M21, the CPU 10A executes processing in steps S140*a*to S142*a*. If "2" is stored in the memory M21, the CPU 10A executes processing in steps S143*a*to S146*a*, and the flow advances to step S149.

In step S149, the CPU 10A reads out a first coefficient α1 from a memory M11. The reference correction amount of each ink key opening ratio is multiplied by the readout first coefficient α1 to obtain the correction amount of each ink key opening ratio. The obtained correction amount is stored in a memory M13 (step S150). The obtained correction amounts of the ink key opening ratios are output to motor drivers 11A in motor control devices 11 (step S153*a*). Upon receiving the ink key opening ratio correction end signals from all the motor control devices 11 ("YES" in step S154*a*), the flow returns to step S107 to repeat the loop of step S107→S112*a*→S112*b*→S119→S120.

[Change of Allowable Density Difference for Color Matching During Final Printing]

First, "0" is stored in the allowable value condition memory M22 for color matching during final printing. In step S112*b*, when the allowable value condition input switch SW42 is turned on once, "1" is stored in the allowable value condition memory M22 (step S112*b*→S113*b*→S114*b*→S116*b*). When the allowable value condition input switch SW42 is turned on twice, "2" is stored in the allowable value condition memory M21 (step S112*b*→S113*b*→S114*b*→S115*b*→S117*b*).

When the density measurement start switch SW2 is turned on ("YES" in step S119), the CPU 10A executes the processing in steps S121 to S133 shown in FIG. 4B. In step S147 (FIG. 17C) after step S133, the CPU 10A reads out the contents of the memory M1. If "0" is stored in the memory M1 ("NO" in step S148), the CPU 10A determines that it is color matching before the start of final printing, and the flow advances to step S134*a*. If "1" is stored in the memory M1 ("YES" in step S148), the CPU 10A determines that it is color matching during final printing, and the flow advances to step S134*b* (FIG. 17D).

To execute final printing, the operator turns on a printing state input switch SW1 ("YES" in step S107). Accordingly, "1" is stored in the memory M1 (step S108→S109→S110). The CPU 10A determines that it is color matching during final printing, and the flow advances to step S134*b*.

In step S134*b*, the CPU 10A reads out the contents of the allowable value condition memory M22 (step S134*b*). If "0" is stored in the memory M22, the CPU 10A executes processing in steps S136*b* to S138*b*. If "1" is stored in the memory M22, the CPU 10A executes processing in steps S140*b* to S142*b*. If "2" is stored in the memory M22, the CPU 10A executes processing in steps S143*b* to S146*b*, and the flow advances to step S151.

In step S151, the CPU 10A reads out a second coefficient α2 from a memory M12. The reference correction amount of each ink key opening ratio is multiplied by the readout second coefficient α2 to obtain the correction amount of each ink key opening ratio. The obtained correction amount is stored in the memory M13 (step S152). The obtained correction amounts of the ink key opening ratios are output to the motor drivers 11A in the motor control devices 11 (step S153*b*). Upon receiving the ink key opening ratio correction end signals from all the motor control devices 11 ("YES" in step S154*b*), the flow returns to step S107 to repeat the loop of step S107→S112*a*→S112*b*→S119→S120.

Sixth Embodiment

In the fifth embodiment, when the printing state input switch SW1 is turned on, the contents of the memory M1 are changed from "0" to "1" and it is determined that final printing is progressing. In the sixth embodiment, when the operation state of a counter which counts the number of properly printed paper sheet is an ON state, it is determined that final printing is progressing, as in the second embodiment.

Figure 17D:
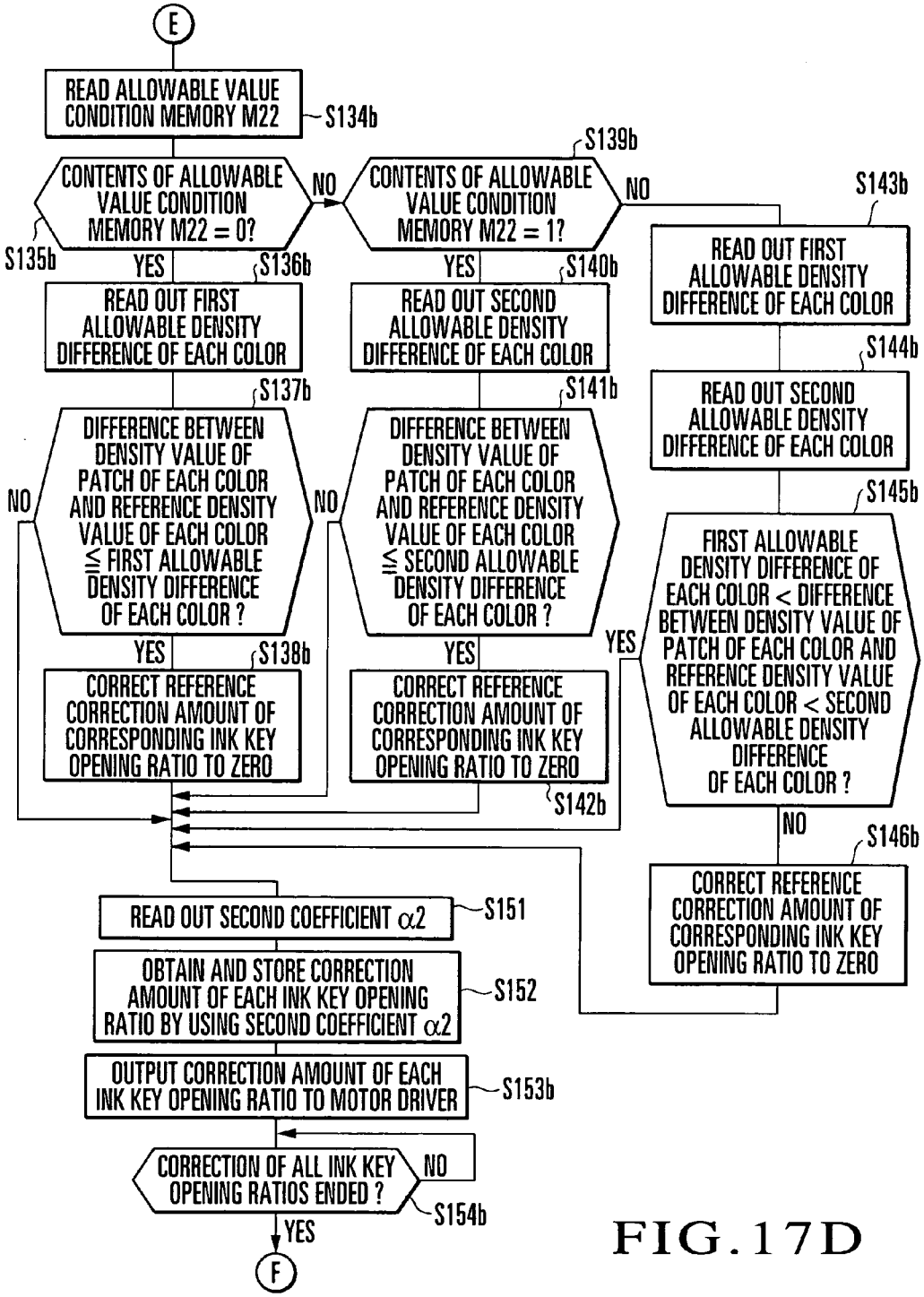
Figure 18:
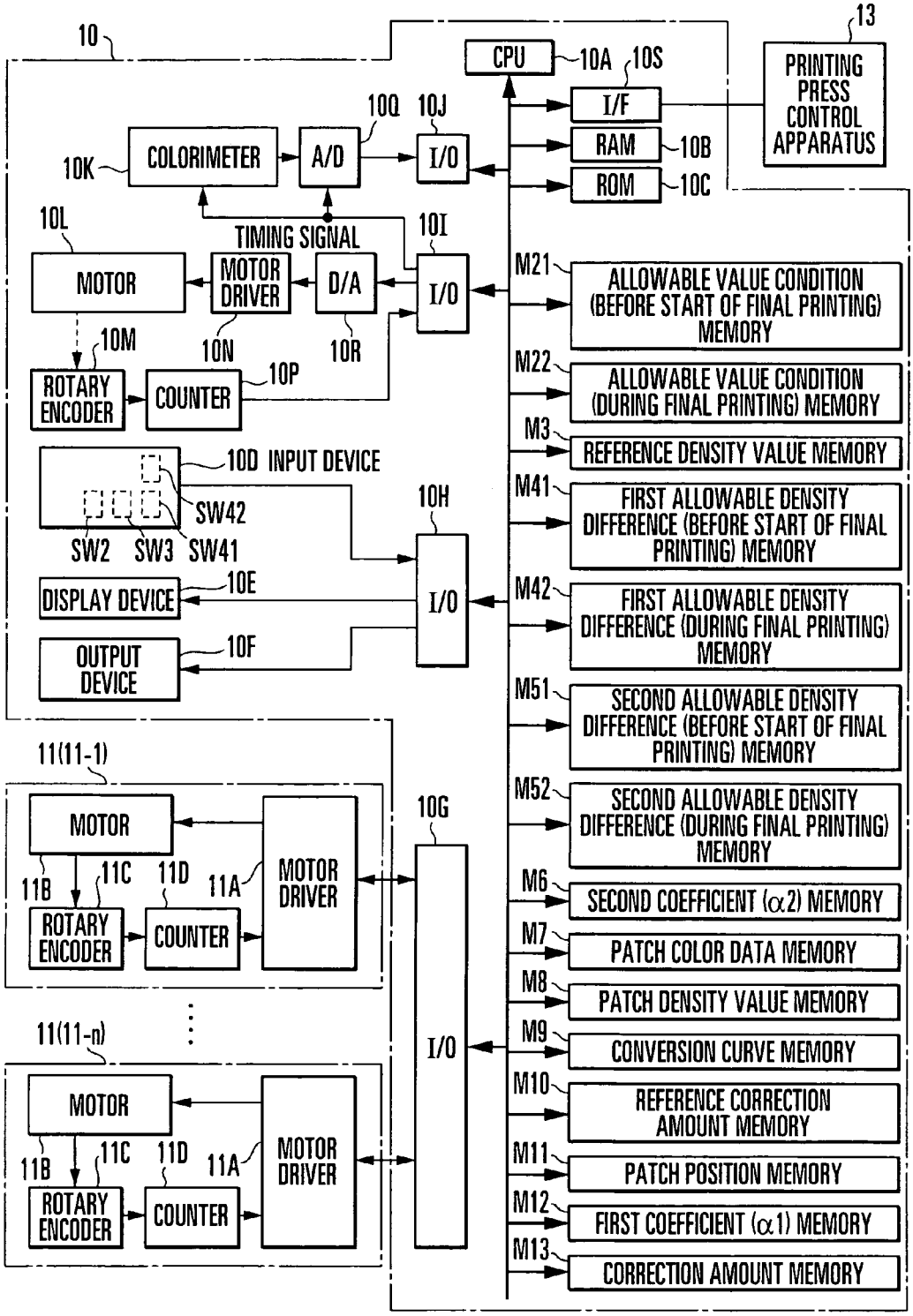
FIG. 18 is a block diagram of an ink supply amount adjustment apparatus according to the sixth embodiment of the present invention.
Figure 19A:
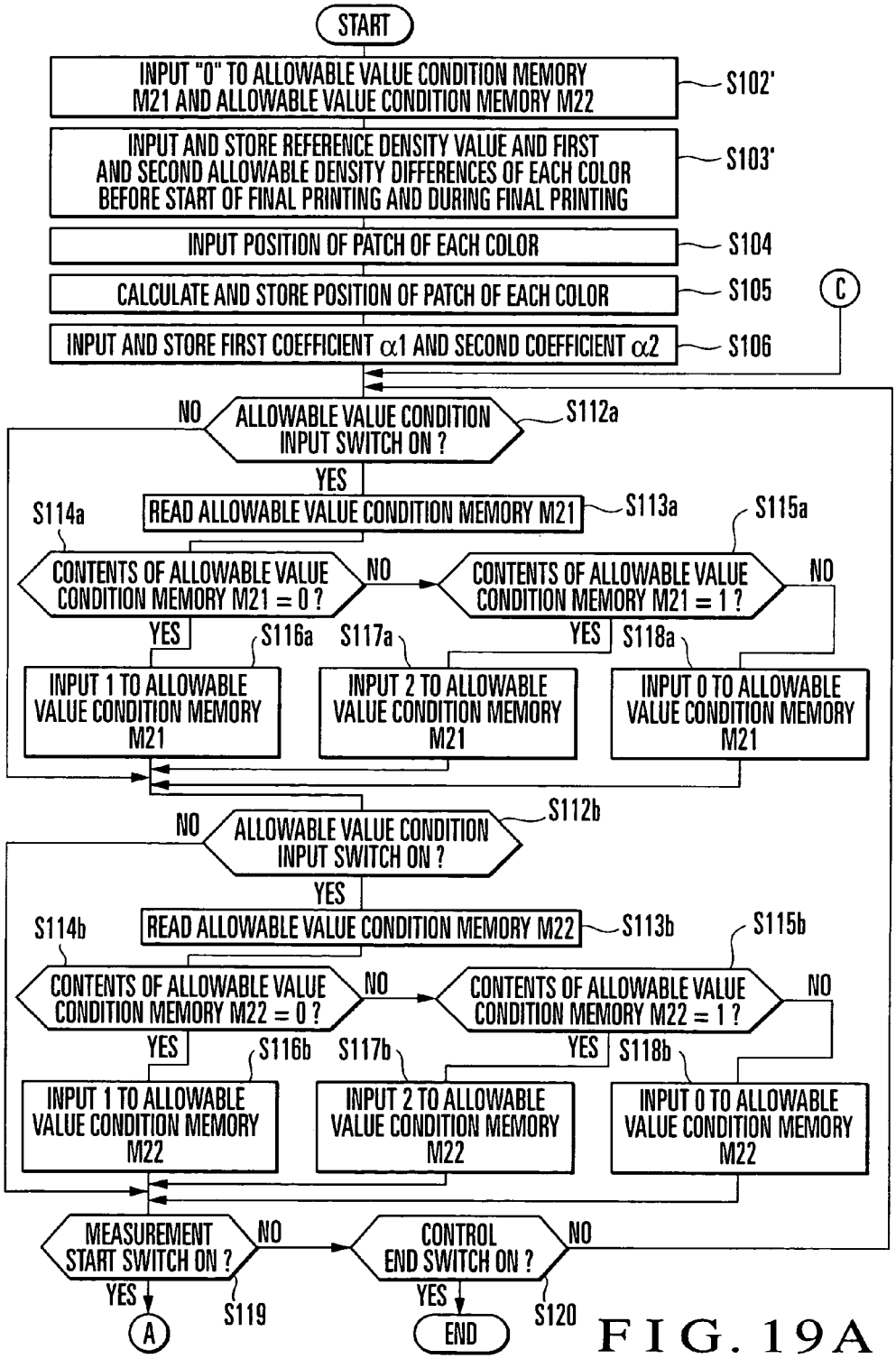
FIGS. 19A and 19B are flowcharts showing the processing operation of the ink supply amount adjustment apparatus shown in FIG. 18.
Figure 19B:
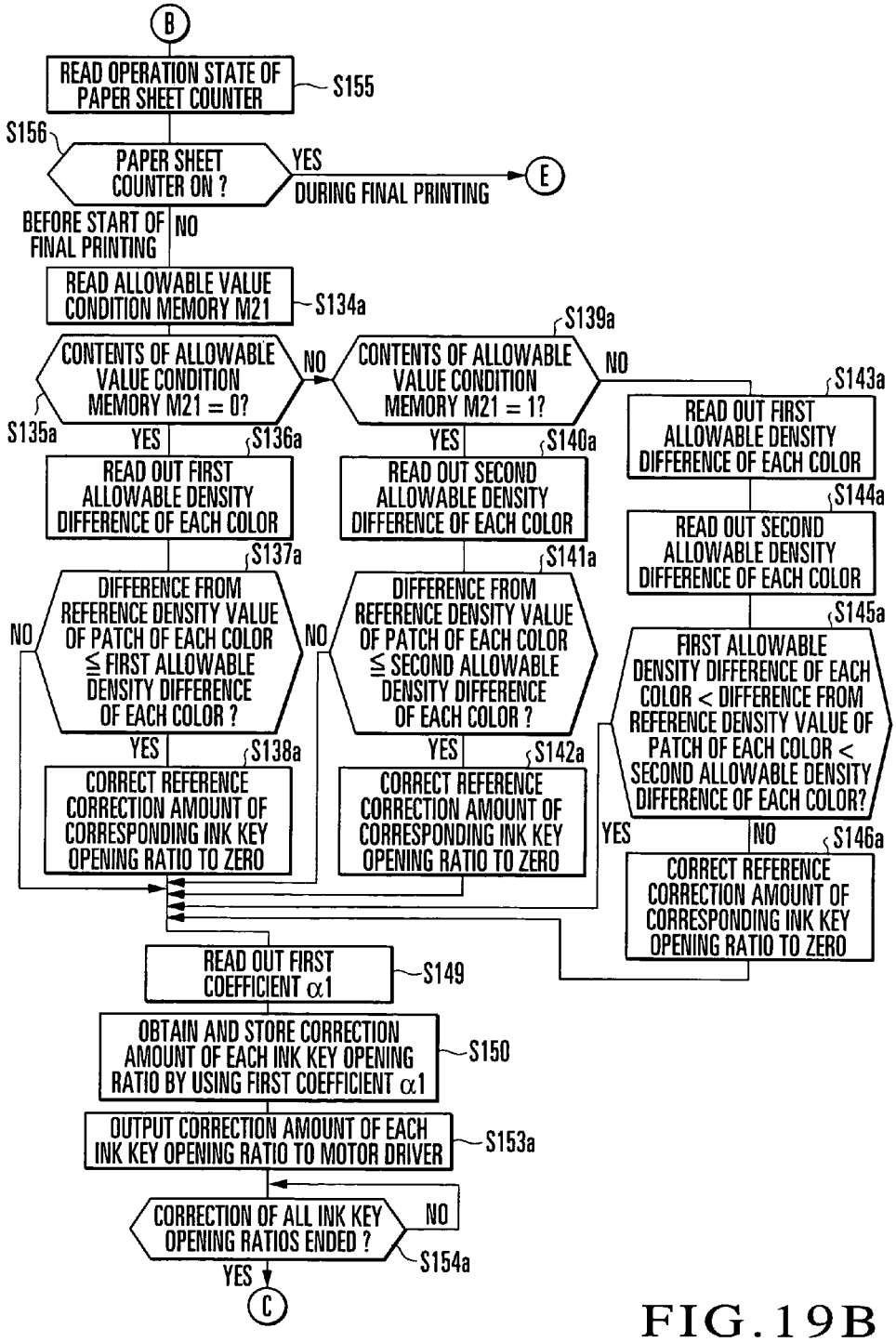

FIGS. 18 to 19B show an ink supply amount adjustment apparatus according to the sixth embodiment of the present invention. FIGS. 19A and 19B show the processing operation executed by a CPU 10A of an ink supply amount adjustment apparatus 10 according to this embodiment. In this embodiment, if "YES" in step S119 shown in FIG. 19A, the flow advances to step S121 shown in FIG. 4B. After step S133 shown in FIG. 4B, the flow advances to step S155 shown in FIG. 19B. If "YES" in step S156 in FIG. 19B, the flow advances to the above-described operation processing (FIG. 17D) during final printing.

Seventh Embodiment

In the seventh embodiment, when the rotational speed of the printing press exceeds a predetermined value (the minimum rotational speed of the printing press in final printing), it is determined that final printing is progressing, as in the third embodiment.

Figure 20:
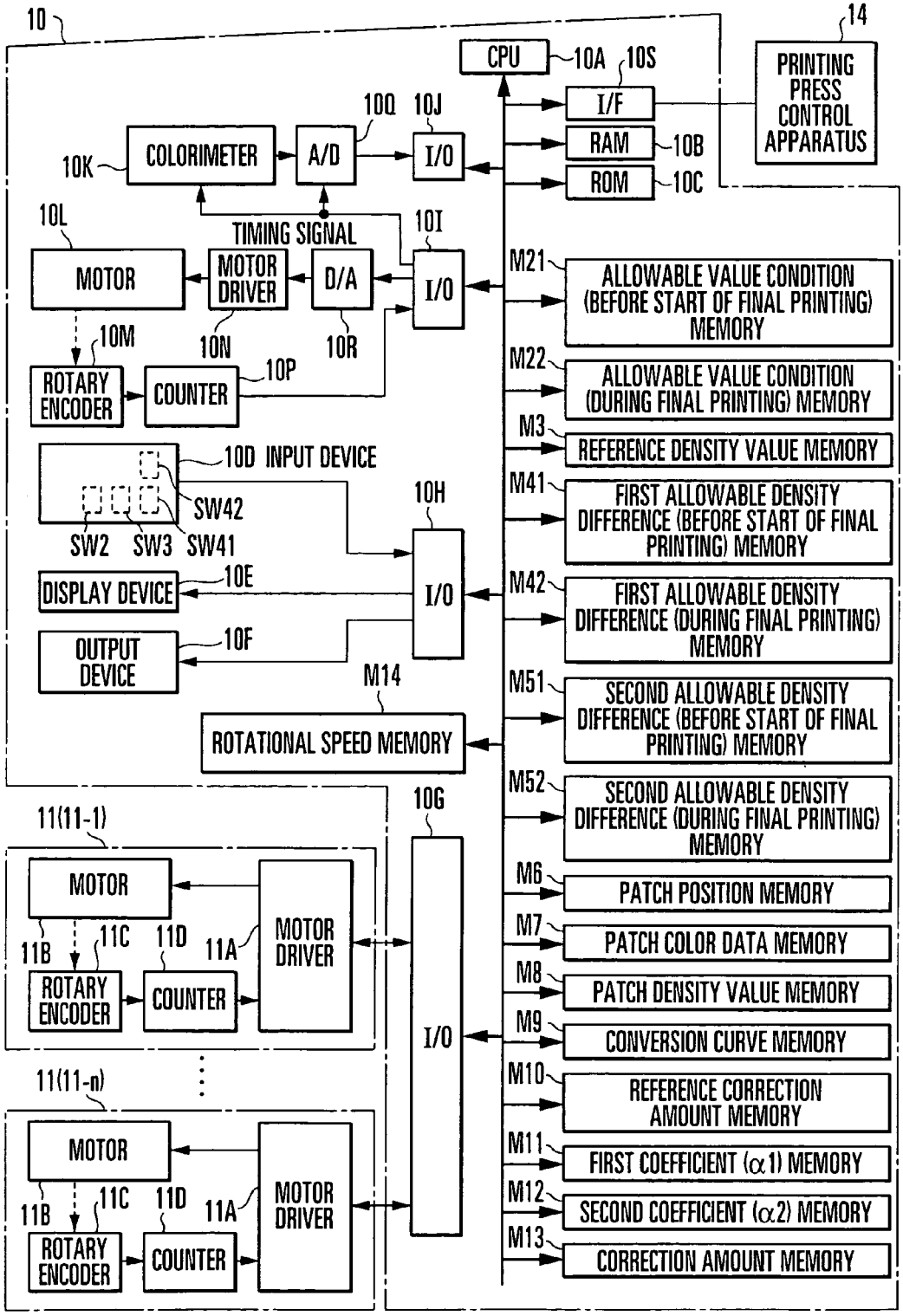
FIG. 20 is a block diagram of an ink supply amount adjustment apparatus according to the seventh embodiment of the present invention.
Figure 21A:
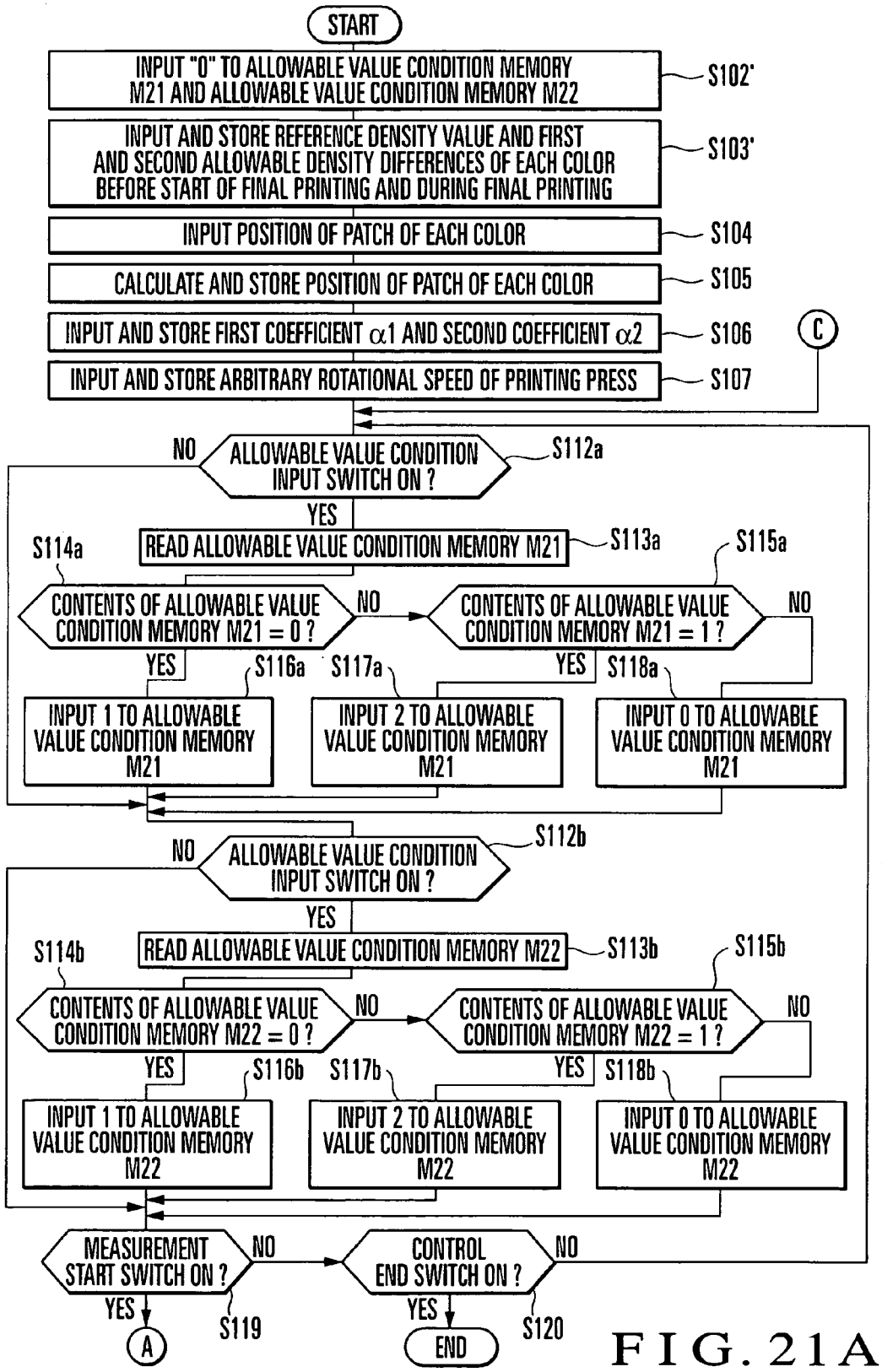
FIGS. 21A and 21B are flowcharts showing the processing operation. of the ink supply amount adjustment apparatus shown in FIG. 20.
Figure 21B:
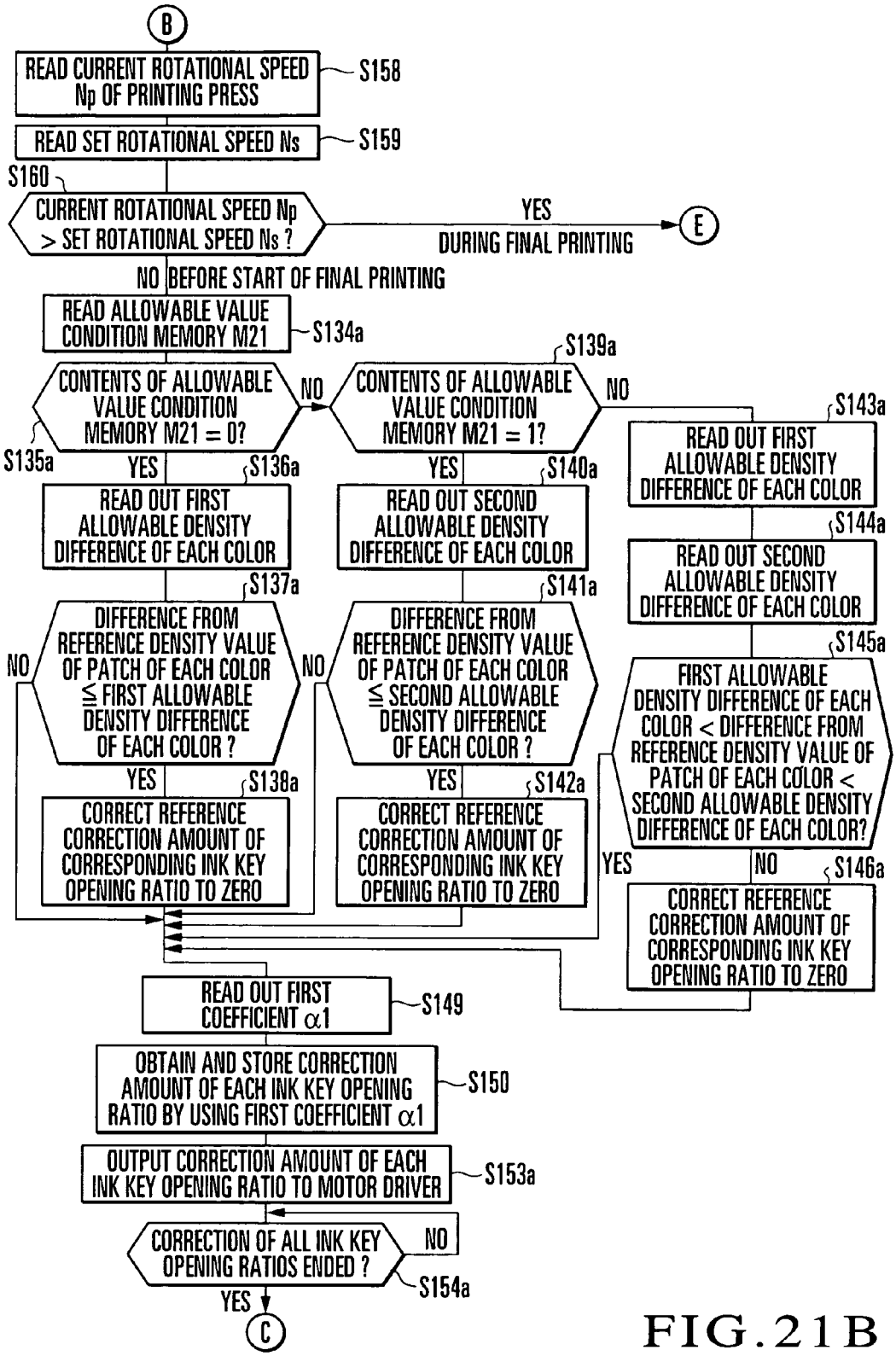

FIGS. 20 to 21B show an ink supply amount adjustment apparatus according to the seventh embodiment of the present invention. FIGS. 21A and 21B show the processing operation executed by a CPU 10A of an ink supply amount adjustment apparatus 10 according to this embodiment. In this embodiment, if "YES" in step S119 shown in FIG. 21A, the flow advances to step S121 shown in FIG. 4B. After step S133 shown in FIG. 4B, the flow advances to step S158 shown in FIG. 21B. If "YES" in step S160 in FIG. 21B, the flow advances to the above-described operation processing (FIG. 17D) during final printing.

Eighth Embodiment

In the eighth embodiment, the difference between the precedingly measured average density value of a patch 9*a* of each color in a color bar 9-2 and the currently measured average density value of the patch 9*a* of each color in the color bar 9-2 is calculated. When the difference is smaller than a predetermined value (set density difference), it is determined that final printing is progressing, as in the fourth embodiment.

Figure 22:
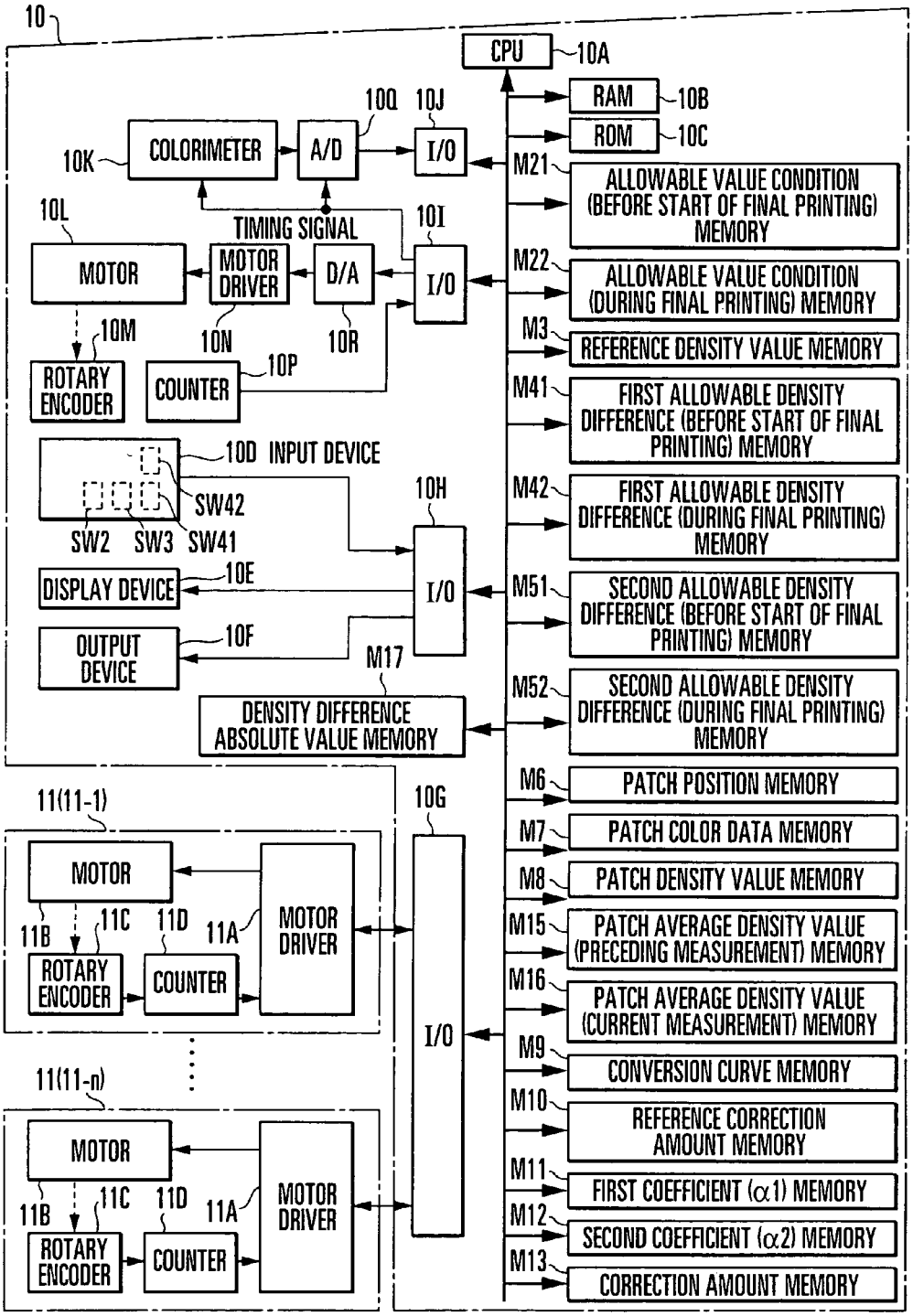
FIG. 22 is a block diagram of an ink supply amount adjustment apparatus according to the eighth embodiment of the present invention.
Figure 23A:
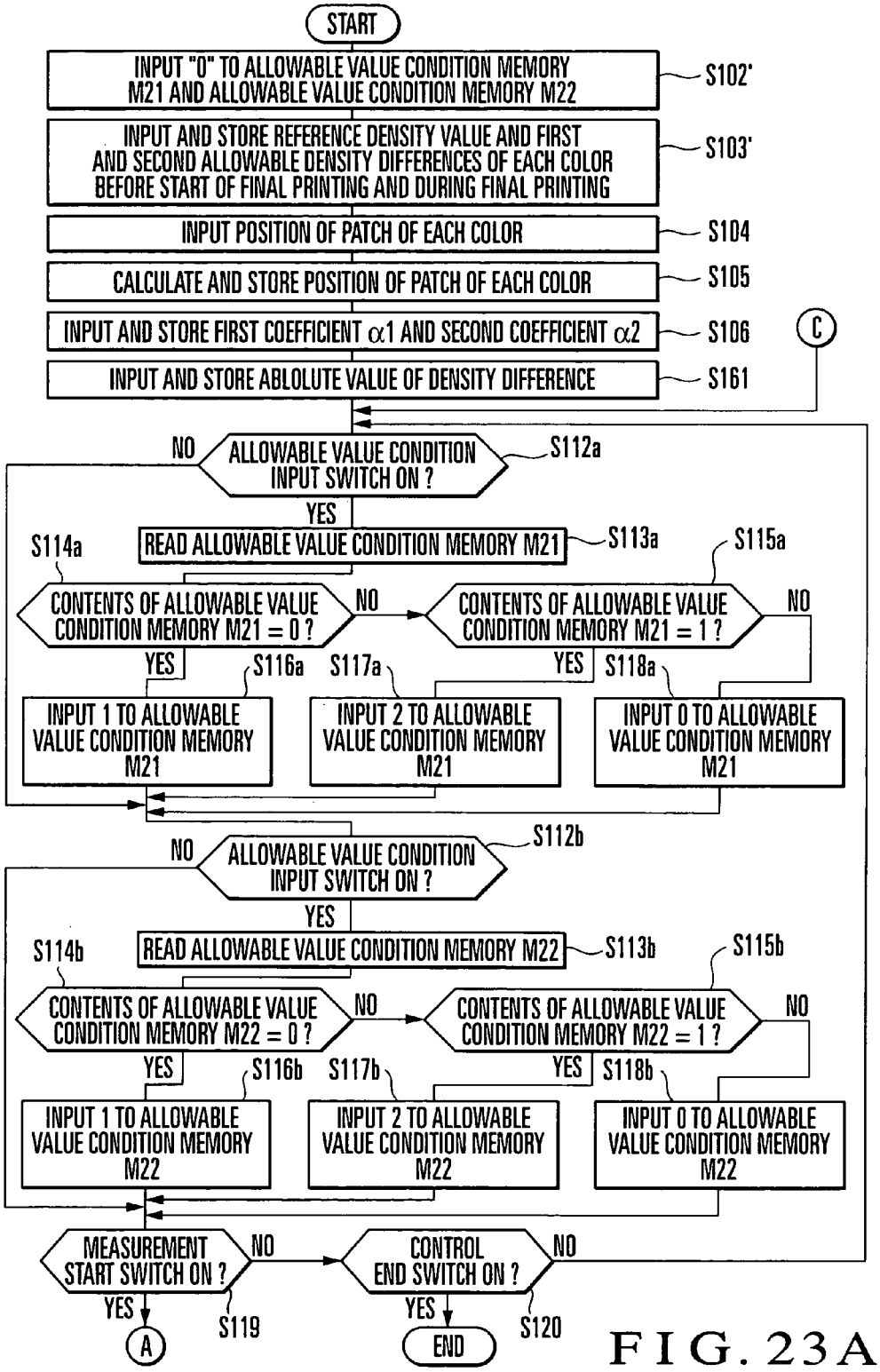
FIGS. 23A and 23B are flowcharts showing the processing operation of the ink supply amount adjustment apparatus shown in FIG. 22.
Figure 23B:
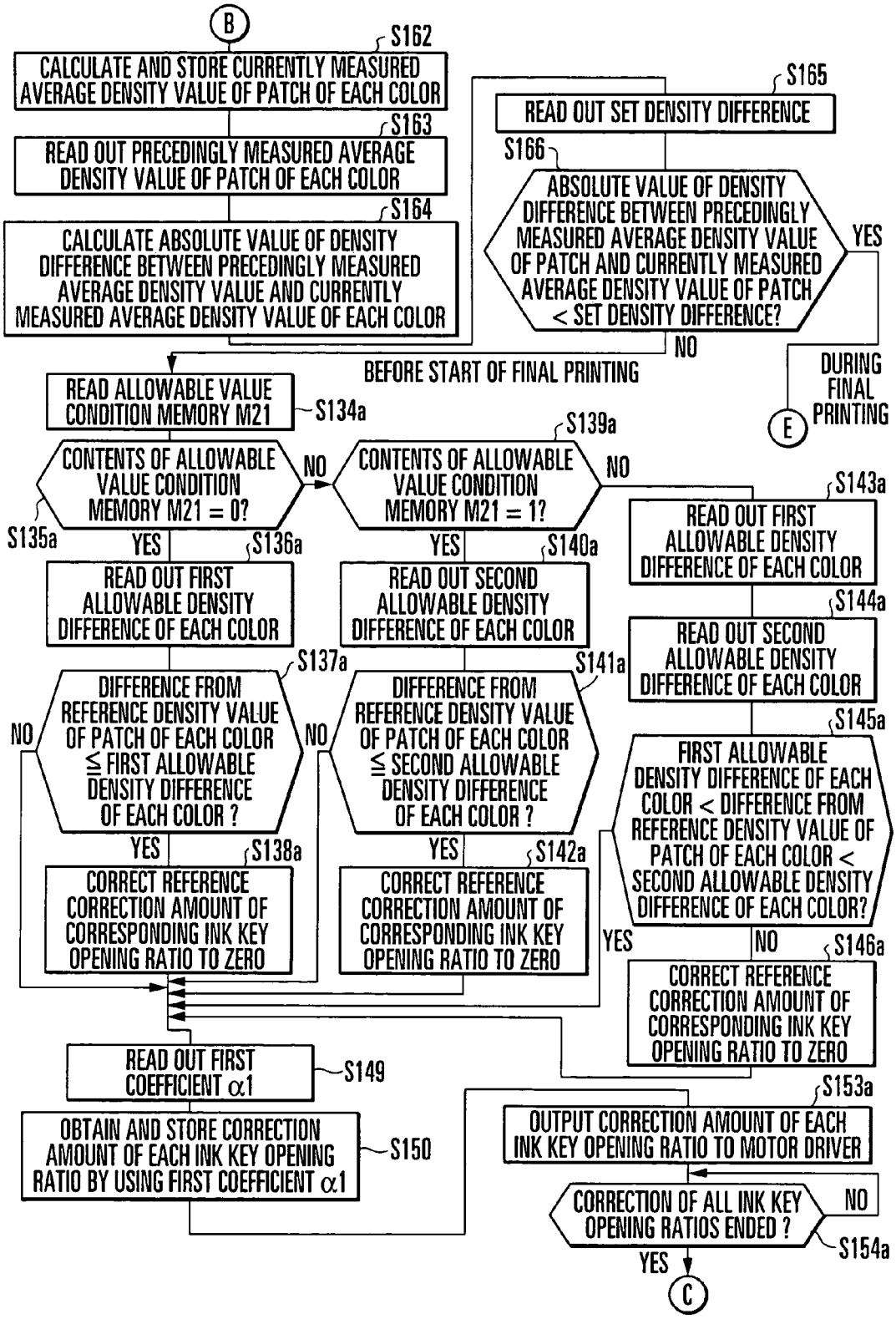

FIGS. 22 to 23B show an ink supply amount adjustment apparatus according to the eighth embodiment of the present invention. FIGS. 23A and 23B show the processing operation executed by a CPU 10A of an ink supply amount adjustment apparatus 10 according to this embodiment. In this embodiment, if "YES" in step S119 shown in FIG. 23A, the flow advances to step S121 shown in FIG. 4B. After step S133 shown in FIG. 4B, the flow advances to step S162 shown in FIG. 23B. If "YES" in step S166 in FIG. 23B, the flow advances to the above-described operation processing (FIG. 17D) during final printing.

In the above-described first to eighth embodiments, the density value is obtained on the basis of colorimetric data from the colorimeter. The density value may directly be obtained by using a densitometer in place of the calorimeter. The ink key opening ratio correction value is obtained by multiplying the reference correction amount of the ink key opening ratio by a coefficient (control ratio). Instead, the ink key opening ratio correction amount is obtained by using a conversion table (a conversion curve representing the relationship between the reference correction amount and the correction amount). Before the start of final printing, the correction amount of the ink key opening ratio is obtained by using a first conversion table. During final printing, the correction amount of the ink key opening ratio is obtained by using a second conversion table different from the first conversion table.

Instead of obtaining the ink key correction amount by multiplying the reference correction amount of the ink key opening ratio by a coefficient (control ratio), first and second conversion tables may be arranged. The first conversion table represents the relationship between the density difference and the correction amount before the start of final printing. The second conversion table represents the relationship between the density difference and the correction amount during final printing. In this case, before the start of final printing, the correction amount of the ink key opening ratio is obtained directly from the density difference by using the first conversion table. During final printing, the correction amount of the ink key opening ratio is obtained directly from the density difference by using the second conversion table.

Figure 24:
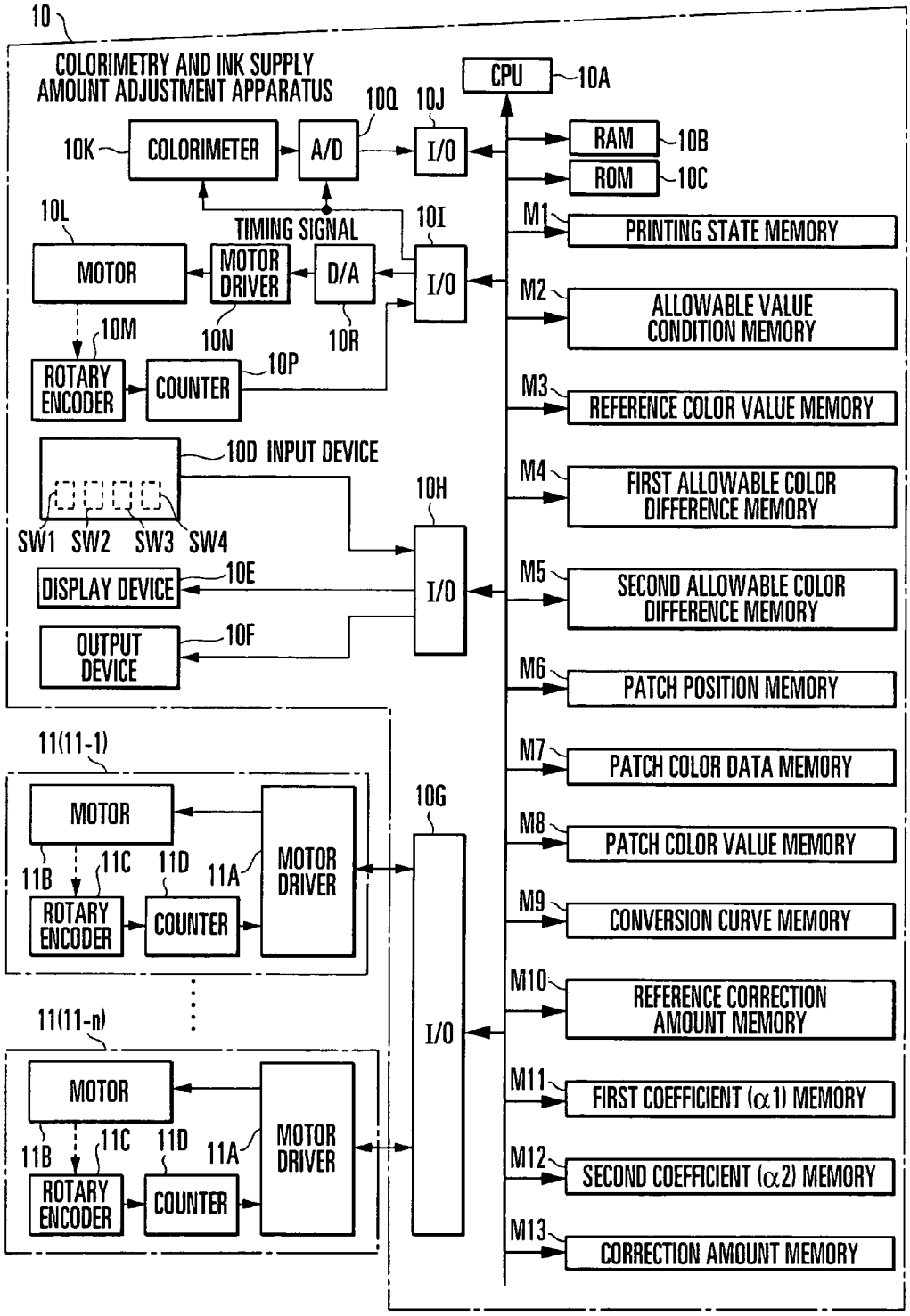
FIG. 24 is a block diagram of an ink supply amount adjustment apparatus corresponding to the first embodiment when "density value" is changed to "color value", and "density difference" is changed to "color difference"
Figure 25A:
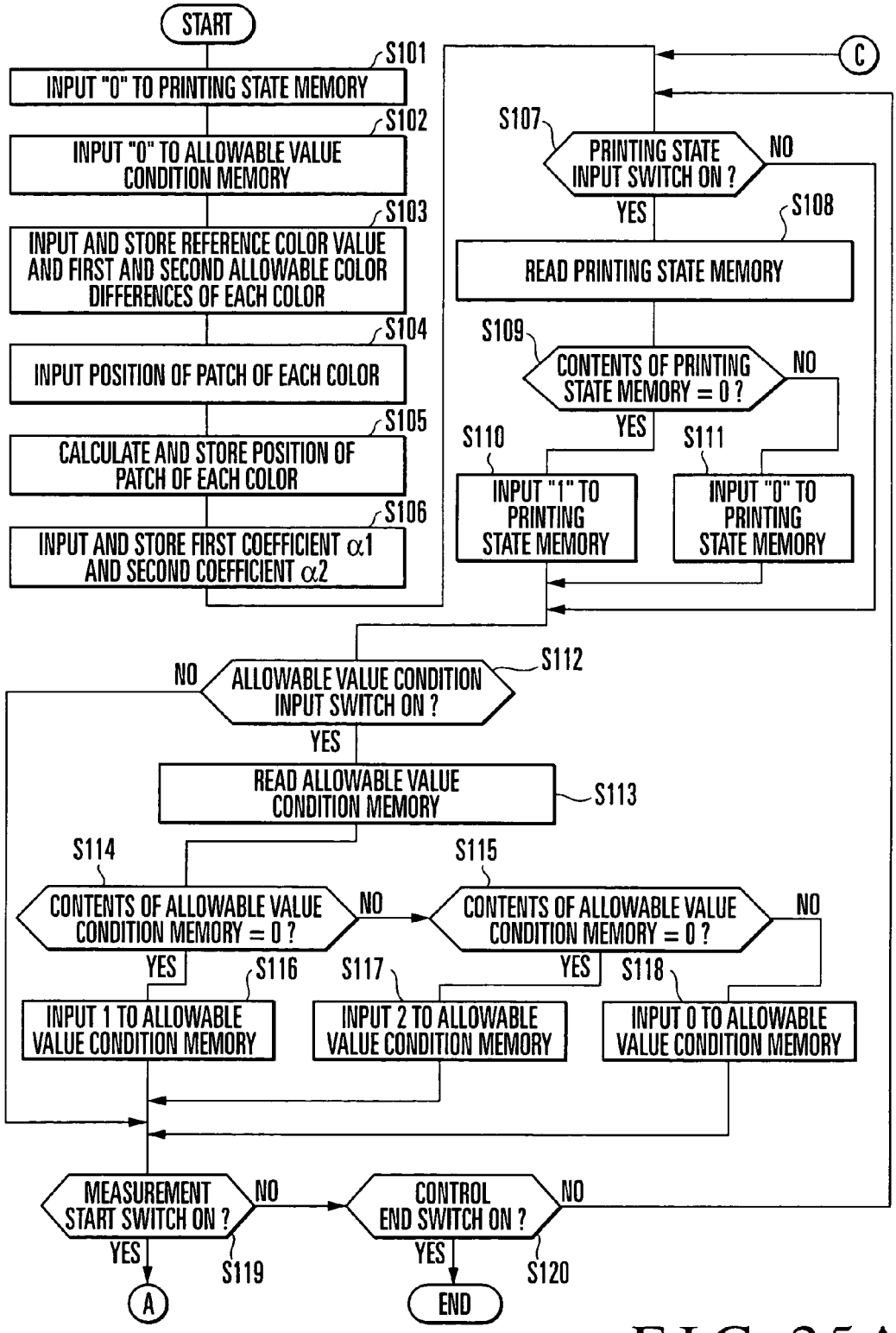
FIGS. 25A to 25C are flowcharts showing the processing operation of the ink supply amount adjustment apparatus corresponding to the first embodiment when "density value" is changed to "color value", and "density difference" is changed to "color difference"
Figure 25B:
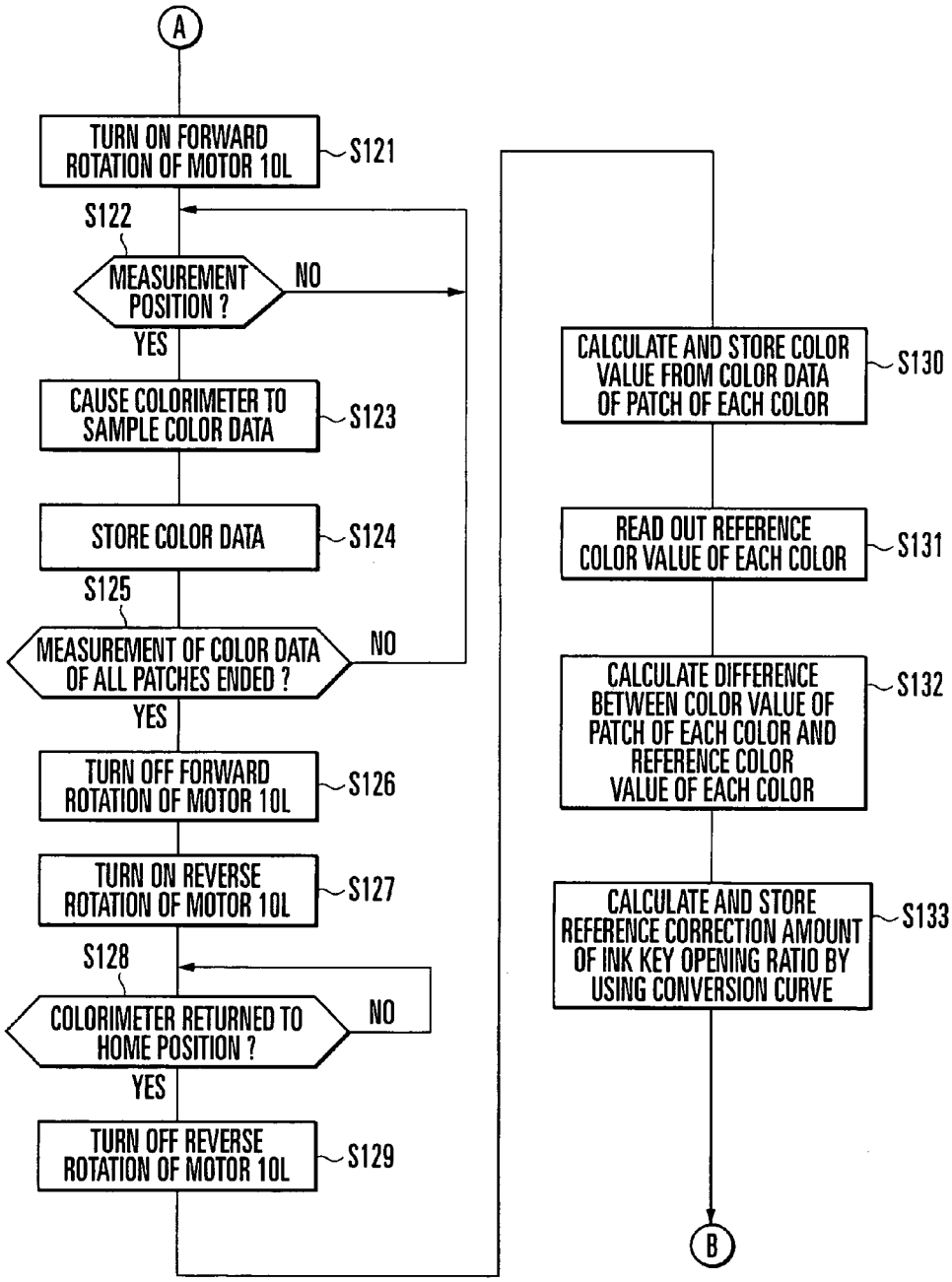
Figure 25C:
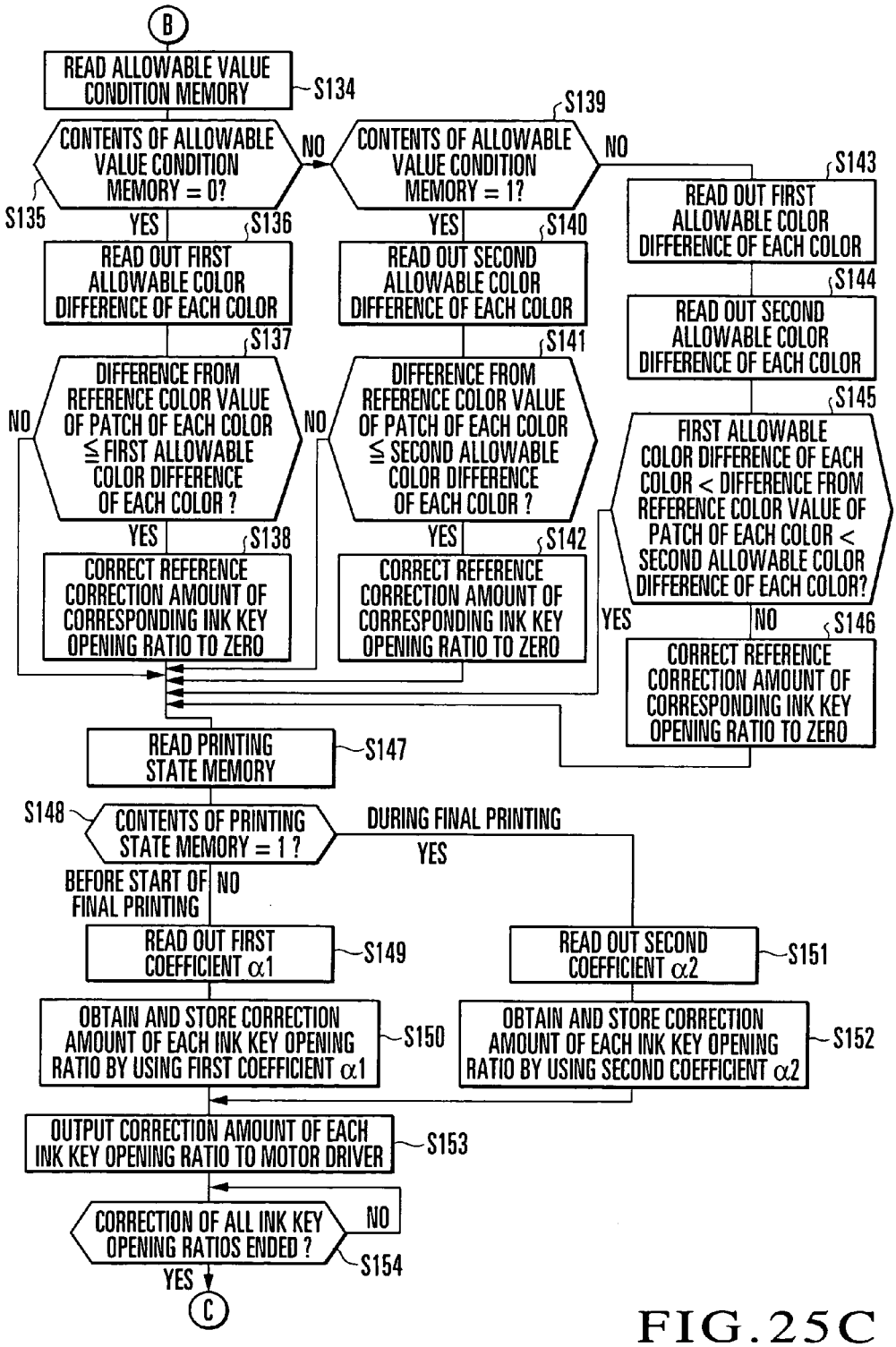

In the above-described first to eighth embodiments, color matching is executed on the basis of the density value. Color matching can also be executed by using a color value in place of the density value. In this case, in the first embodiment, "density value" is changed to "color value", and "density difference" is changed to "color difference" in the block diagram shown in FIG. 1 so that the block diagram shown in FIG. 24 is obtained. In addition, "density value" is changed to "color value", and "density difference" is changed to "color difference" in the flowcharts shown in FIGS. 4A to 4C so that the flowcharts shown in FIGS. 25A to 25C are obtained.

Figure 16:
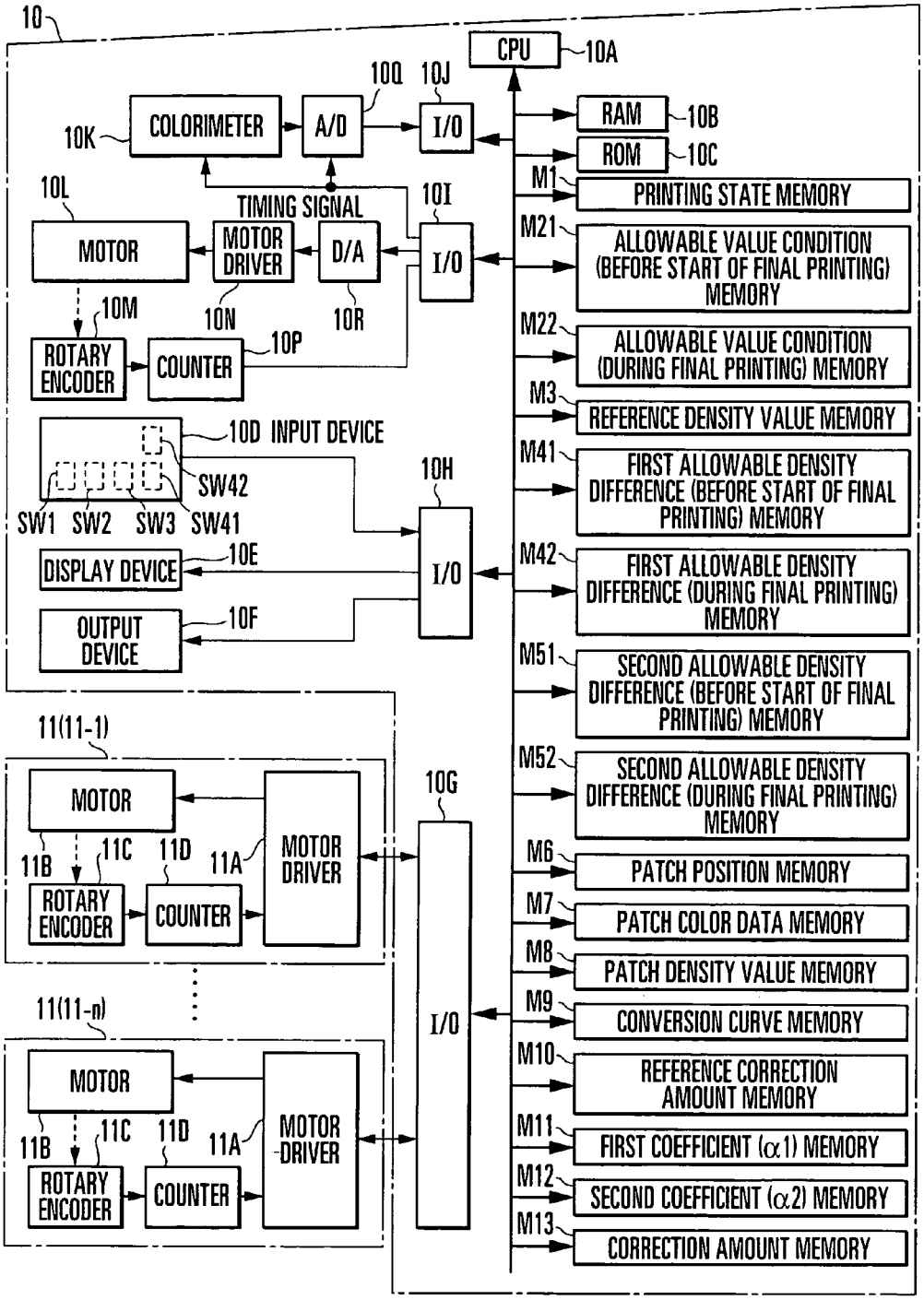
FIG. 16 is a block diagram of an ink supply amount adjustment apparatus according to the fifth embodiment of the present invention.
Figure 26:
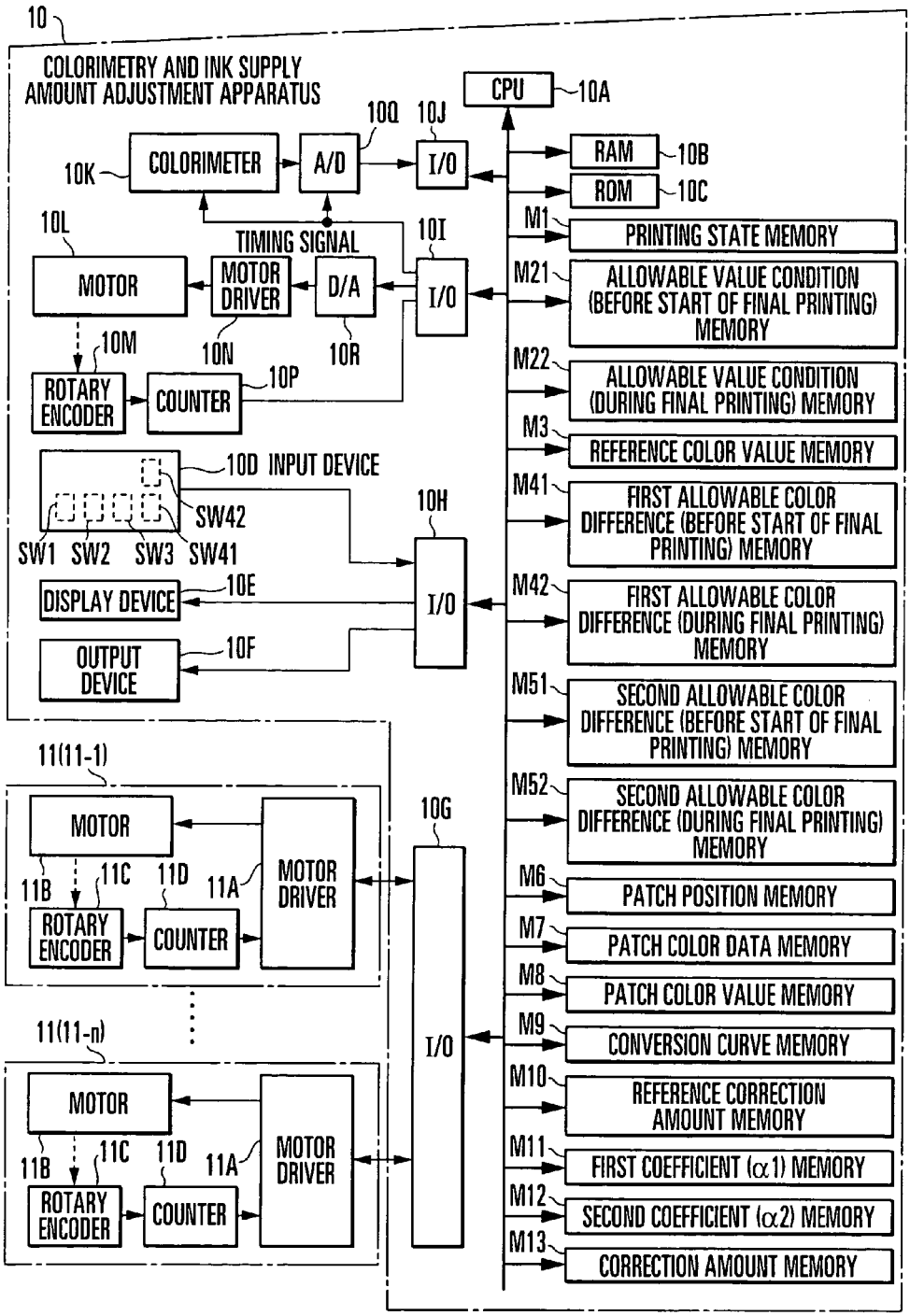
FIG. 26 is a block diagram of an ink supply amount adjustment apparatus corresponding to the fifth embodiment when "density value" is changed to "color value", and "density difference" is changed to "color difference"
Figure 27A:
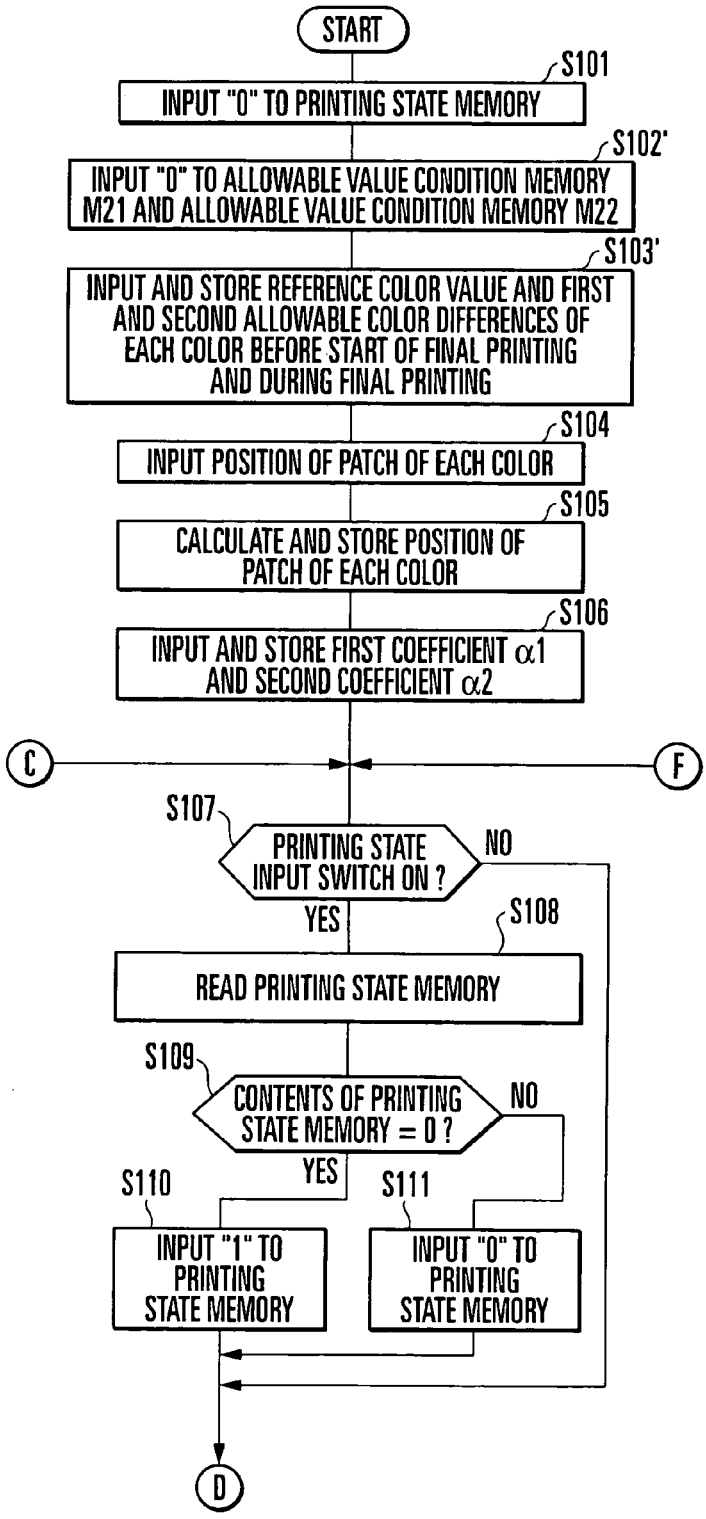
FIGS. 27A to 27C are flowcharts showing the processing operation of the ink supply amount adjustment apparatus corresponding to the fifth embodiment when "density value" is changed: to "color value", and "density difference" is changed to "color difference"
Figure 27B:
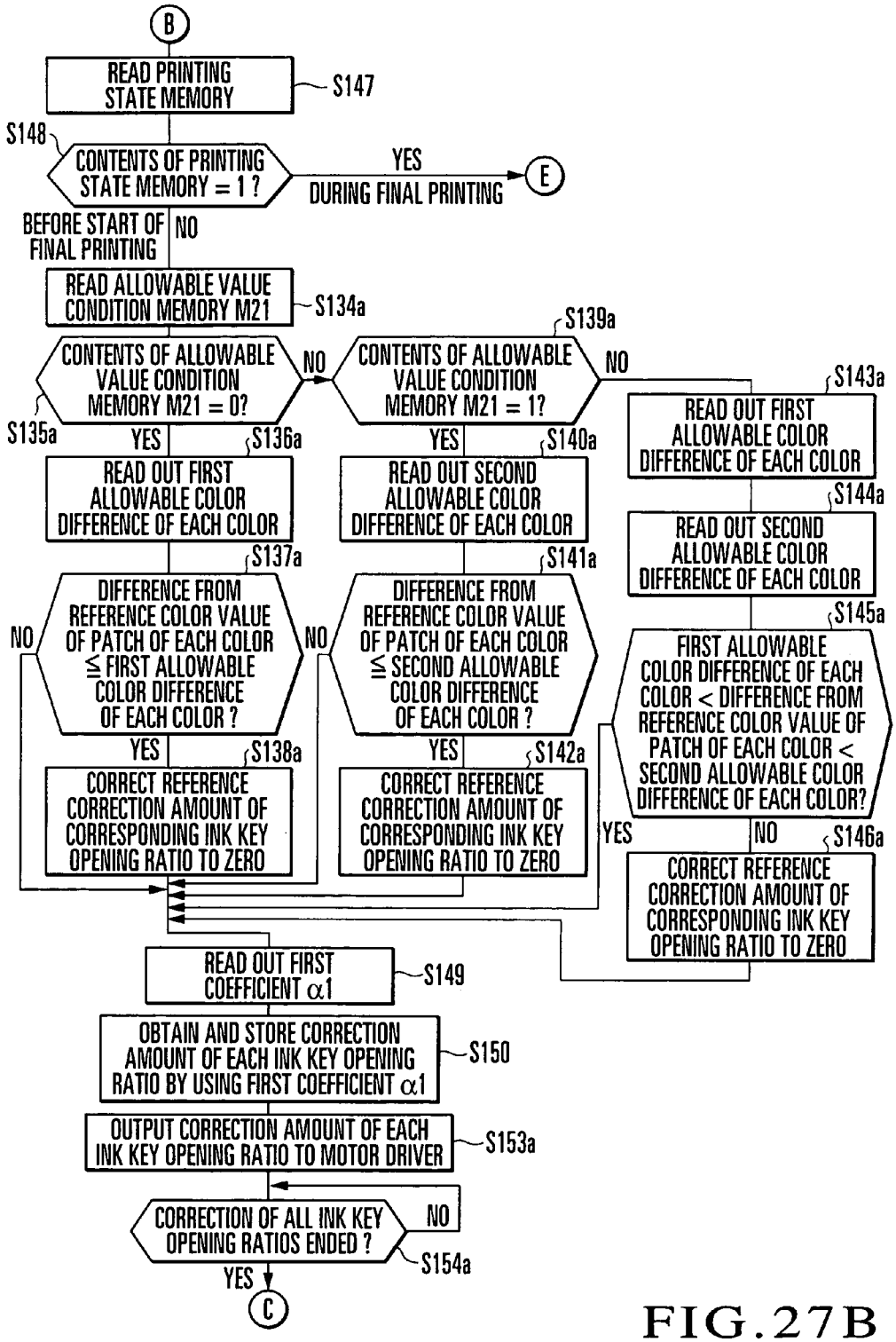
Figure 27C:
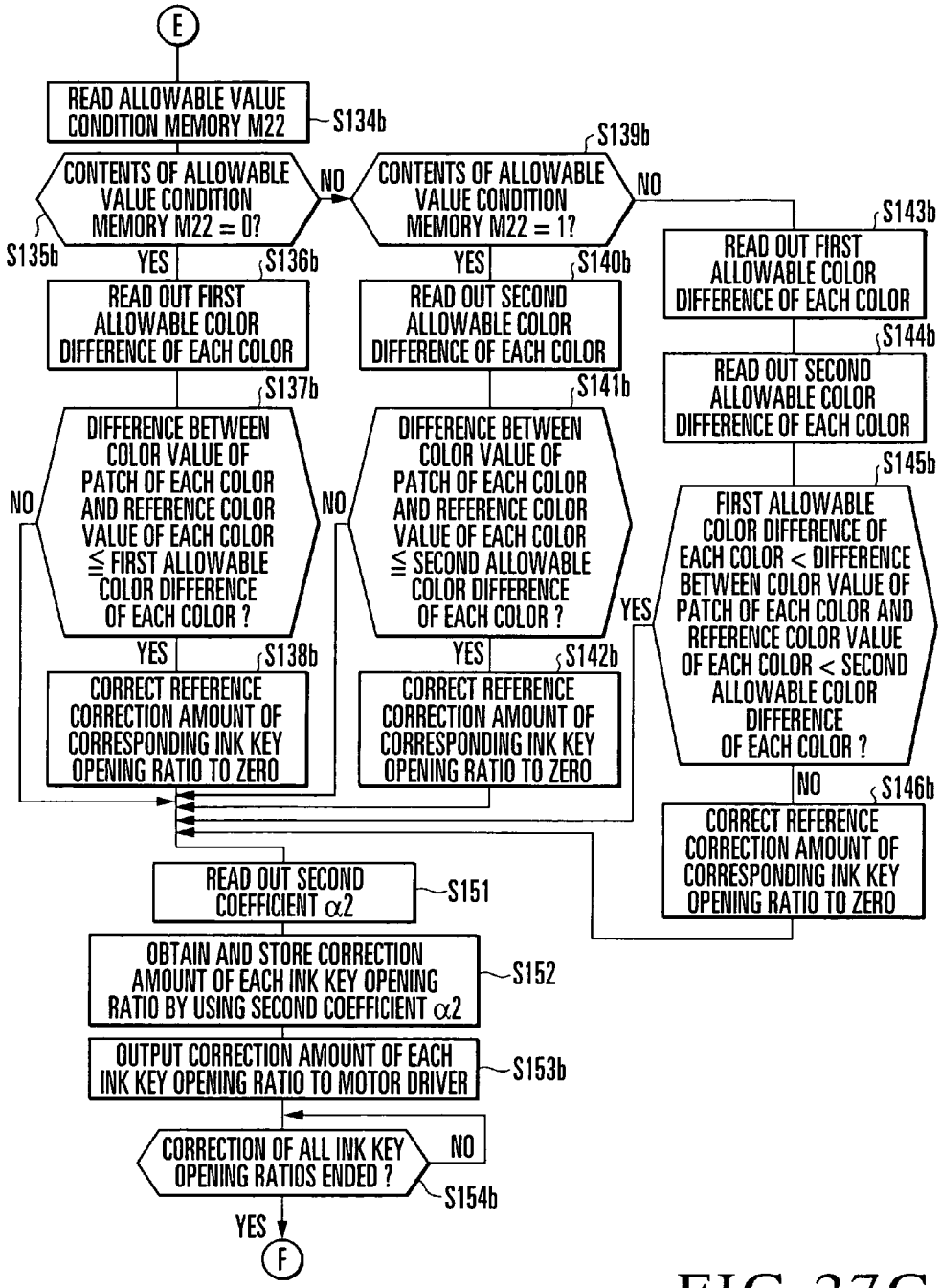

In the fifth embodiment, "density value" is changed to "color value", and "density difference" is changed to "color difference" in the block diagram shown in FIG. 16 so that the block diagram shown in FIG. 26 is obtained. In addition, "density value" is changed to "color value", and "density difference" is changed to "color difference" in the flowcharts shown in FIGS. 17A, 17C, and 17D so that the flowcharts shown in FIGS. 27A to 27C are obtained. FIG. 17A corresponds to FIG. 27A. FIG. 17C corresponds to FIG. 27B. FIG. 17D corresponds to FIG. 27C. FIG. 17B is used without any change. In this case, the CPU 10A obtains not the density value but a color value from the color data sampled by the colorimeter 10K. Even in the second to fourth embodiments, and the sixth to eighth embodiments, when "density value" is changed to "color value", and "density difference" is changed to "color difference", similar block diagrams and flowcharts can be obtained.

A color value indicates an "L* value, a* value, and b* value" represented by the L*a*b* colorimetric system or an "L* value, u* value, and v* value" represented by the L*u*v* calorimetric system as a color display method defined by JIS Z8729 in the Japanese Industrial Standard (JIS) and recommended by the Commission Internationale de l'Eclairage (CIE).

According to the present invention, before color matching, the operator or the manager of the site of printing selects one of the first, second, and third ink supply amount adjustment modes to adjust the ink supply amount. In the first ink supply amount adjustment mode, when the measured density difference/measured color difference is larger than the first allowable density difference/allowable color difference, the ink supply amount is adjusted. In the second ink supply amount adjustment mode, when the measured density difference/measured color difference is larger than the second allowable density difference/allowable color difference, the ink supply amount is adjusted. In the third ink supply amount adjustment mode, when the measured density difference/measured color difference falls between the first allowable density difference/allowable color difference and the second allowable density difference/allowable color difference, the ink supply amount is adjusted. When an optimum ink supply amount adjustment mode is selected from the three modes, the hunting phenomenon of the ink thickness on the paper sheet can be suppressed. In addition, the amount of wasted paper can be decreased even when an unexpected accident has occurred on a printing product.

What is claimed is:

1. An ink supply amount adjustment method for a printing press, comprising the steps of:

measuring one of a density value and a color value of a printing product; obtaining a difference between the measurement value and a preset reference value related to one of the density value and the color value;

determining, in accordance with a set allowance mode, a relationship between the obtained difference and at least one of a preset first allowable difference and a preset second allowable difference larger than the first allowable difference, wherein the determining step comprises the steps of:

determining whether the obtained difference is larger than the first allowable difference for a first allowance mode, determining whether the obtained difference is larger than the second allowable difference for a second allowance mode, and determining whether the obtained difference falls between the first allowable difference and the second allowable difference for a third allowance mode; and adjusting an ink supply amount in accordance with a determination result, wherein the adjusting step comprises:

executing an ink supply amount adjustment operation for the first allowance mode, and the obtained difference is larger than the first allowable difference, for the second allowance mode, and the obtained difference is larger than the second allowable difference, and for the third allowance mode, and the obtained difference falls between the first allowable difference and the second allowable difference.

2. A method according to claim 1, wherein the adjusting step comprises the step of executing an ink supply amount adjustment operation in one of color matching before a start of final printing and color matching during final printing in accordance with a set printing state mode representing a relationship between final printing and color matching.

3. A method according to claim 2, wherein the adjusting step comprises the steps of driving an ink key by using a correction amount of an ink key opening ratio based on a first coefficient in color matching before the start of final printing, and driving the ink key by using a correction amount of an ink key opening ratio based on a second coefficient different from the first coefficient in color matching during final printing.

4. A method according to claim 2, further comprising the step of causing an operator to set the printing state mode before color matching.

5. A method according to claim 1, wherein the measuring step comprises the step of measuring the density value of the printing product, the obtaining step comprises the step of obtaining a density difference between the measured density value and a preset reference density value, and the determining step comprises the step of determining a relationship between the obtained density difference and at least one of a preset first allowable density difference and a preset second allowable density difference.

6. A method according to claim 1, wherein the measuring step comprises the step of measuring the color value of the printing product, the obtaining step comprises the step of obtaining a color difference between the measured color value and a preset reference color value, and the determining step comprises the step of determining a relationship between the obtained color difference and at least one of a preset first allowable color difference and a preset second allowable color difference.

7. A method according to claim 1, further comprising the step of causing an operator to set the allowance mode before color matching.

8. An ink supply amount adjustment apparatus for a printing press, comprising:

measurement means for measuring one of a density value and a color value of a printing product;

arithmetic means for obtaining a difference between the measurement value from said measurement means and a preset reference value related to one of the density value and the color value;

allowance mode setting means in which an allowance mode is set;

determination means for determining, in accordance with the allowance mode set in said allowance mode setting means, a relationship between the difference output from said arithmetic means and at least one of a preset first allowable difference and a preset second allowable difference larger than the first allowable difference; and ink supply amount adjustment means for adjusting an ink supply amount in accordance with a determination result from said determination means, wherein said determination means determines whether the difference from said arithmetic means is larger than the first allowable difference for a first allowance mode, determines whether the difference from said arithmetic means is larger than the second allowable difference for a second allowance mode, and determines whether the difference from said arithmetic means falls between the first allowable difference and the second allowable difference for a third allowance mode, and said ink supply amount adjustment means adjusts the ink supply amount for the first allowance mode, and the difference from said arithmetic means is larger than the first allowable difference, adjusts the ink supply amount for the second allowance mode, and the difference from said arithmetic means is larger than the second allowable difference, and adjusts the ink supply amount for the third allowance mode, and the difference from said arithmetic means falls between the first allowable difference and the second allowable difference.

9. An apparatus according to claim 8, further comprising printing state mode setting means in which a printing state mode representing a relationship between final printing and color matching is set, wherein said ink supply amount adjustment means executes an ink supply amount adjustment operation in one of color matching before a start of final printing and color matching during final printing in accordance with the printing state mode set in said printing state mode setting means.

10. An apparatus according to claim 9, wherein said ink supply amount adjustment means comprises driving means for driving an ink key by using a correction amount of an ink key opening ratio based on a first coefficient in color matching before the start of final printing, and driving the ink key by using a correction amount of an ink key opening ratio based on a second coefficient different from the first coefficient in color matching during final printing.

11. An apparatus according to claim 8, wherein said measurement means measures the density value of the printing product, said arithmetic means obtains a density difference between the measured density value output from said measurement means and a preset reference density value, and said determination means determines a relationship between the obtained density difference and at least one of a preset first allowable density difference and a preset second allowable density difference.

12. An apparatus according to claim 8, wherein said measurement means measures the color value of the printing product, said arithmetic means obtains a color difference between the measured color value output from said measurement means and a preset reference color value, and said determination means determines a relationship between the obtained color difference and at least one of a preset first allowable color difference and a preset second allowable color difference.

13. An apparatus according to claim 8, further comprising reference value setting means in which the reference value is set, first allowable difference setting means in which the first allowable difference is set in advance, and second allowable difference setting means in which the second allowable difference is set in advance.

* * * * *